US006698827B2

(12) United States Patent
Le Gette et al.

(10) Patent No.: US 6,698,827 B2
(45) Date of Patent: Mar. 2, 2004

(54) COLLAPSIBLE SUPPORT AND METHODS OF USING THE SAME

(75) Inventors: Brian Edward Le Gette, Baltimore, MD (US); Alan Tipp, Baltimore, MD (US); Justin Saul Werner, Millersville, MD (US); Ronald L. Wilson, II, Catonsville, MD (US)

(73) Assignee: Gray Matter Holdings, LLC, Baltimore, MD (US)

( * ) Notice: Subject to any disclaimer, the term of this patent is extended or adjusted under 35 U.S.C. 154(b) by 99 days.

(21) Appl. No.: 09/797,948

(22) Filed: Mar. 5, 2001

(65) Prior Publication Data

US 2003/0011217 A1 Jan. 16, 2003

(51) Int. Cl.[7] ..... A47C 4/30

(52) U.S. Cl. ..... 297/16.2; 297/17; 297/45; 297/129

(58) Field of Search ..... 297/16.2, 17, 36, 297/129, 217.1

(56) References Cited

U.S. PATENT DOCUMENTS

| | | | | |
|---|---|---|---|---|
| 180,610 A | | 8/1876 | Lungren | 297/16.2 X |
| 244,216 A | | 7/1881 | Fenby | |
| 291,062 A | | 1/1884 | Latour | |
| 1,035,823 A | | 8/1912 | Hay | |
| 1,979,278 A | | 11/1934 | McMurty | |
| 2,473,090 A | | 6/1949 | Becker | |
| 2,690,792 A | | 10/1954 | Moss | |
| 2,691,410 A | | 10/1954 | Boucher | |
| 2,973,888 A | | 3/1961 | Beardsley | |
| 3,124,387 A | | 3/1964 | MacLaren | 297/16.2 |
| 3,662,932 A | * | 5/1972 | Kerschner | 297/17 X |
| 3,838,883 A | | 10/1974 | Machen | 297/45 |
| 4,014,591 A | | 3/1977 | Gittings | 297/55 |
| 4,047,753 A | | 9/1977 | Uchida | 297/131 X |
| 4,148,520 A | | 4/1979 | Miller | 297/16.1 |
| 4,258,951 A | | 3/1981 | Groom | 297/16.2 |
| 4,300,707 A | * | 11/1981 | Kjaer | 297/129 X |
| 4,359,244 A | | 11/1982 | Koehm | 297/16.2 |
| 4,605,261 A | | 8/1986 | Lee | 297/16.2 |
| 4,671,566 A | | 6/1987 | Knapp et al. | 297/16.2 |
| 4,673,211 A | | 6/1987 | Hoffman | 297/16.2 |
| 4,676,548 A | | 6/1987 | Bradbury | 297/17 X |
| 4,717,201 A | * | 1/1988 | Barras | 297/16.2 |
| 4,807,930 A | | 2/1989 | Helfrich | 297/16.2 |
| 4,836,601 A | | 6/1989 | Cone | 297/16.2 |
| 4,836,938 A | * | 6/1989 | Kobasic | 297/129 X |
| 4,889,383 A | * | 12/1989 | Jones | 297/17 X |
| 5,016,792 A | * | 5/1991 | Jay | 297/17 X |
| 5,054,849 A | | 10/1991 | Hoff | 297/45 |

(List continued on next page.)

OTHER PUBLICATIONS

Product label for "Undercover the Sunshade" manufactured by Della USA.

Shakespeare Deluxe High Back Lounge Chair*Outdoor World of California* http://www.outdoorworldca.com/products/specs/dlxhilou.htm.

Sand Chair, *The Crate and Barrel 1993 Spring and Summer Catalogue*.

Portable Chair, *MotorHome*, Sep. 1994 pp. 106.

Lafuma Sport/Travel Chair *Campmor Late Spring 1994*.

Werland's Handcrafted Rocking Chairs pamphlet, Austin Texas.

*Primary Examiner*—Rodney B. White
(74) *Attorney, Agent, or Firm*—Cooley Godward LLP

(57) ABSTRACT

A support including a frame having a tension member coupled to the frame is disclosed. The frame has a collapsed configuration and an expanded configuration. The tension member is disposable in a first position to provide support for an arm of a user and a second position to be carried on a shoulder of the user.

35 Claims, 24 Drawing Sheets

U.S. PATENT DOCUMENTS 5,139,308 A 8/1992 Ziman ..... 297/129 X
5,150,945 A 9/1992 Aupperlee et al.
5,332,283 A 7/1994 Gray ..... 297/16.2 X
5,409,291 A * 4/1995 Lamb et al. ..... 297/129
5,499,760 A * 3/1996 Pielocik ..... 297/129 X
5,499,857 A 3/1996 Lynch, Jr. ..... 297/16.2
5,527,088 A * 6/1996 MacLean ..... 297/129
5,536,064 A * 7/1996 MacLean ..... 297/129
5,544,793 A * 8/1996 Harrop ..... 297/17 X
5,588,696 A 12/1996 Jay et al. ..... 297/129
5,628,437 A * 5/1997 Kober ..... 297/129 X
5,718,473 A 2/1998 Lynch, Jr. ..... 297/16.2
5,893,605 A 4/1999 Chang ..... 297/16.2 X
5,984,406 A * 11/1999 Lee ..... 297/16.2
6,030,034 A 2/2000 Plohetski ..... 297/188.06
6,045,177 A 4/2000 Grace ..... 297/45
6,048,023 A 4/2000 Lampton ..... 297/129
6,056,172 A 5/2000 Welsh ..... 297/129 X
6,082,813 A * 7/2000 Chen ..... 297/16.2
6,095,599 A 8/2000 Lambert ..... 297/129
D430,976 S 9/2000 Tow
6,145,716 A * 11/2000 Caicedo ..... 297/129 X
6,164,726 A * 12/2000 Reeves et al. ..... 297/16.2 X
6,217,113 B1 * 4/2001 Knatz ..... 297/129 X
6,231,119 B1 * 5/2001 Zheng ..... 297/16.2
6,237,993 B1 * 5/2001 Zheng ..... 297/16.2
6,247,748 B1 * 6/2001 Zheng ..... 297/16.2
6,247,749 B1 * 6/2001 Yu ..... 297/16.2
6,247,750 B1 * 6/2001 Tsai ..... 297/16.2
6,250,712 B1 * 6/2001 Livington et al. ..... 297/17 X
6,302,479 B1 * 10/2001 Zheng ..... 297/16.2
6,322,138 B1 * 11/2001 Tang ..... 297/16.2 X

* cited by examiner

COLLAPSIBLE SUPPORT AND METHODS OF USING THE SAME

BACKGROUND OF THE INVENTION

This invention relates generally to a support having multiple configurations, and in particular, to a support that can be positioned in an expanded configuration and a collapsed configuration.

Some conventional supports can be used as chairs to support a user. Such chairs are often transported and used in various outdoor settings. Difficulty exists in transporting a chair. For example, conventional chairs cannot be easily collapsed and transported due to the shape and weight of the chairs.

The need exists for a collapsible support that can be easily transported to various locations.

SUMMARY OF THE INVENTION

A support includes a frame and a tension member. The support can be positioned in a collapsed configuration and an expanded configuration. In one embodiment, the support can be used with a cover that can be positioned around a portion of the frame.

In one embodiment, the support includes a seat portion coupled to the frame. In the open or expanded configuration, a user can sit on the support and the frame is self-supporting.

When the frame is in its expanded configuration, the tension member is coupled to the frame to provide support for an arm of the user. When the frame is in its collapsed configuration, a cover can be placed over a portion of the frame or support. In this configuration, the tension member is not contained by and extends from the cover, thereby enabling a user to place the tension member over the user's shoulder for transporting the support.

DETAILED DESCRIPTION OF THE INVENTION

A support includes a seat portion, a frame, and a tension member. The frame can be positioned in a collapsed configuration and an expanded configuration in which the frame is self-supporting. The tension member is disposable in a first position to provide support for an arm of a user and a second position to be carried on a shoulder of a user. When the frame is in its collapsed configuration, the tension member can be placed over a user's shoulder to transport the support. When the frame is in its expanded configuration, the tension member can be disposed in its first position to support an arm of a user.

Figure 1:
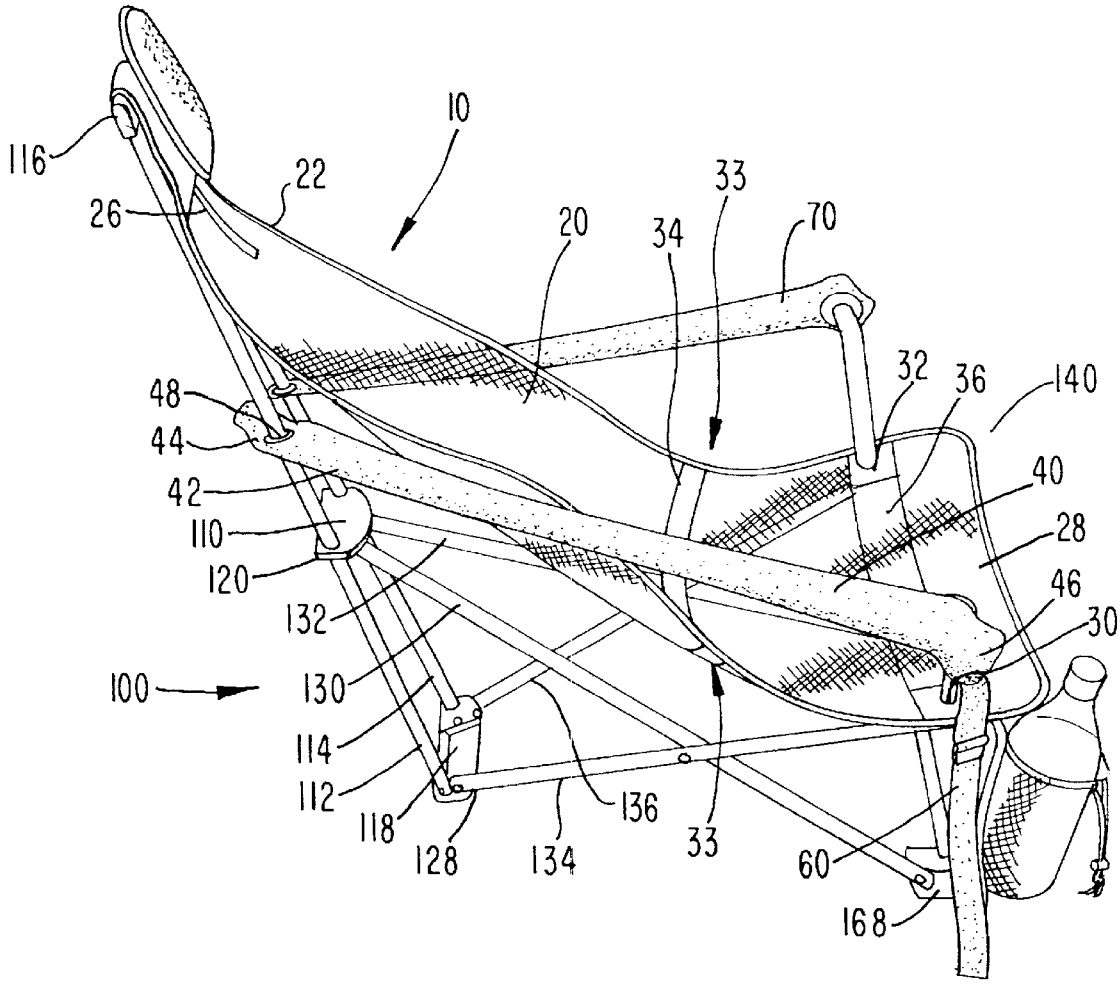
FIG. 1 illustrates a side view of a support according to an embodiment of the invention.

A support according to an embodiment of the invention is illustrated in FIGS. 1–5. FIG. 1 illustrates a side view of the support or support assembly 10 in a deployed or expanded configuration. In one embodiment, support 10 can be used as a chair in its expanded configuration.

In the illustrated embodiment, the support 10 includes a seat portion 20, tension members 40, 70, and a frame 100. The seat portion 20 and the tension members 40, 70 are coupled to the frame 100.

In the illustrated embodiment, the frame 100 includes a rear frame portion 110 and a front frame portion 140, which are coupled together by upper side support bars 130, 132 and lower side support bars 134, 136.

Each of the support members 130, 132, 134, 136 are pivotally coupled to the front and rear frame portions 110, 140. Upper side support member 130 is pivotally coupled to lower side support member 134 proximate their midpoints. Similarly, upper side support member 132 is pivotally coupled to lower side support member 136.

In one embodiment, the upper ends of lower side support members 134, 136 are bent with respect to the remainder of the support members 134, 136. The bent portions of the lower side support members 134, 136 are located proximate to the seat portion 20. When the frame 100 is in its expanded configuration, the upper ends of the lower side support members 134, 136 do not extend into the seat portion 20 and engage the user on the support 10.

In the illustrated embodiment, the rear frame portion 110 includes support members 112, 114, and a coupler 120. The support members 112, 114 are coupled together at their upper and lower ends by an upper coupler 116 and a lower coupler 118, respectively. Additionally, the lower coupler 118 is pivotally coupled to the ends of lower side support members 134, 136. The rear frame portion 110 has a bottom surface 128 proximate the lower coupler 118. The bottom surface 128 is adapted to rest on a supporting surface.

In the illustrated embodiment, the support members are hollow, metal tubes, such as steel tubes. Support members can be formed of any material and configured in any cross-sectional shape that provides sufficient structural strength to support a user. For example, the support members can be aluminum tubes, plastic tubes, solid metal or plastic bars, etc.

Figure 3:
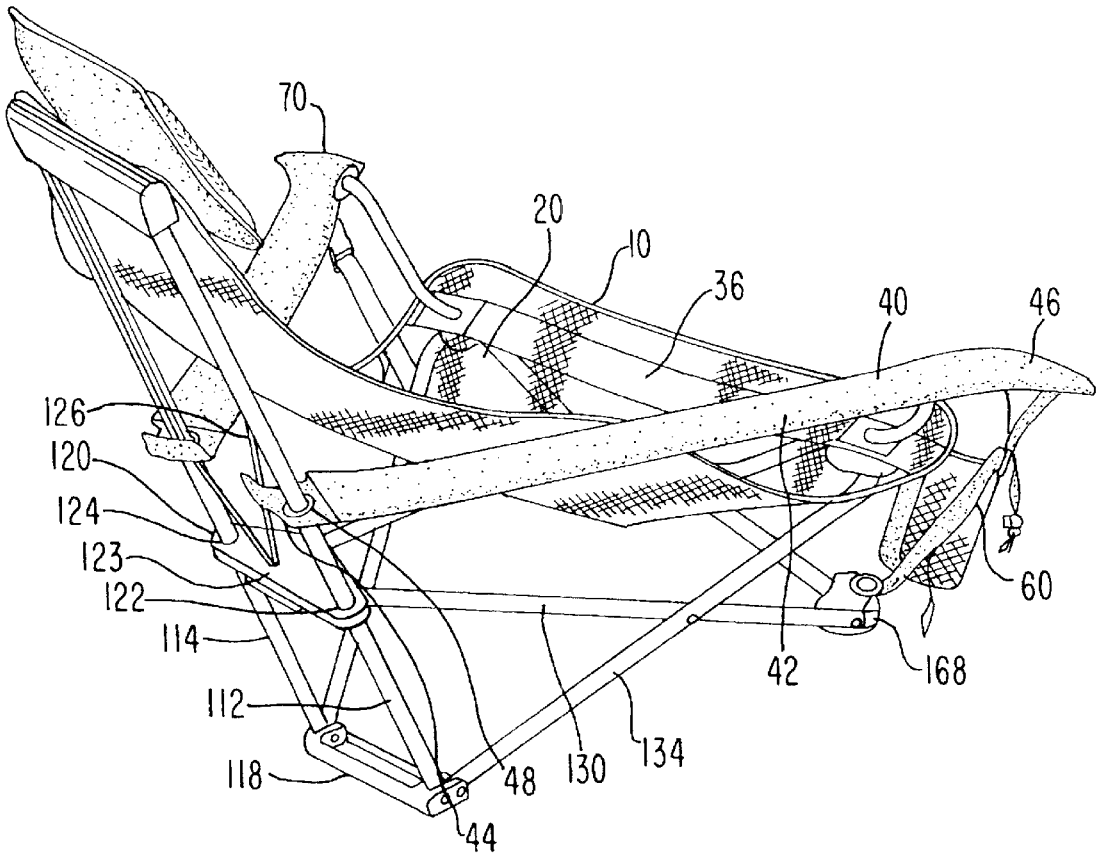
FIG. 3 illustrates a rear perspective view of the support of FIGS. 1 and 2.

In one embodiment, the coupler 120 is a plate that includes holes 122, 124 and is slidably mounted to support members 112, 114. As shown in FIG. 3, support members 112, 114 extend through holes 122, 124, respectively. The holes 122, 124 are sized to slide along the length of support members 112, 114. Slide plate 120 is pivotally coupled to the upper ends of the upper side support members 130, 132.

Figure 2:
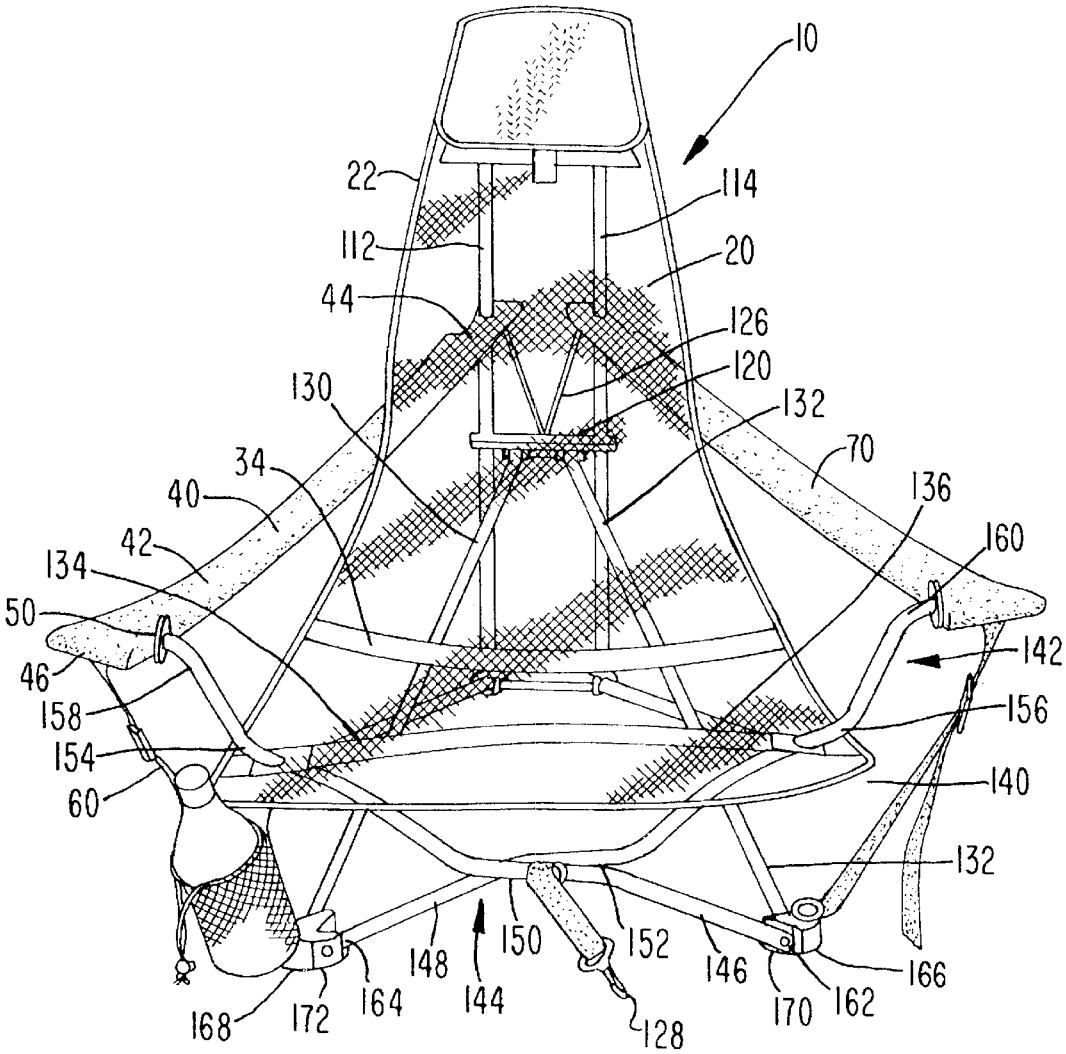
FIG. 2 illustrates a front view of the support of FIG. 1.

As shown in FIGS. 2 and 3, the support 10 includes an extension member 126 coupled to the slide plate 120. In one embodiment, the extension member 126 is a cord. The cord 126 is used to collapse the support 10 from its expanded configuration. The cord 126 is threaded through apertures (not shown) in the upper coupler 116 and connected to the plate 120. The function of the extension member is discussed in further detail below.

While the slide plate is formed of plastic in the disclosed embodiment, any suitable material may be used. Similarly the shape of the slide plate may be varied so long as the slide plate can move along the rear frame portion.

In the illustrated embodiment, the front frame portion 140 includes elongated support members or support members 146, 148 that are pivotally coupled to each other. Support members 146, 148 include upper ends 158, 160 and lower ends 162, 164 and form an "X" structure.

In one embodiment, support members 146, 148 include portions 154, 156 as illustrated in FIG. 2. Portions 154, 156 are substantially linear. When the frame 100 is in its expanded configuration, portions 154, 156 are oriented substantially horizontal and are positioned beneath the membrane 22 to provide support.

In one embodiment, support members 146, 148 include portions 150, 152 as illustrated in FIG. 2. Portions 150, 152 are substantially linear. In this embodiment, the support members 146, 148 are pivotally coupled together at portions 150, 152.

The lower ends 162, 164 of the support members 146, 148 are pivotally coupled to front feet 166, 168, respectively. Each of the front feet 166, 168 has a bottom surface 170, 172 that can engage the surface on which the support 10 is placed. Front feet 166, 168 are pivotally coupled to upper side support members 130, 132.

Support members 146, 148 are coupled to the seat portion 20 and to the lower side support members 134, 136. The seat portion 20 includes apertures or holes 30, 32 through which the support members 146, 148 can be inserted. The upper end of lower side support member 134 is pivotally coupled to the second planar portion 154 of support member 146. Similarly, lower side support member 136 is pivotally coupled to the second planar portion 156 of support member 148.

The front frame portion 140 has an upper portion 142 and a lower portion 144. The upper front frame portion 142 includes the front frame portion 140 located above the seat portion 20. The lower front frame portion 140 includes the front frame portion 140 located below the seat portion 20 in FIG. 2.

In the illustrated embodiment, the frame 100 is a self-supporting structure. When the frame 100 is in its expanded configuration, the weight of the components of the frame 100 hold the frame 100 in its expanded configuration. The frame 100 does not need the seat portion 20 or one of the tension members 40, 70 to remain in its expanded configuration.

In the illustrated embodiment, the seat or seat portion 20 includes a membrane 22 that is supported on the frame 100. The seat portion 20 includes a strip 24 along the perimeter of the membrane 22. The membrane 22 has ends 26, 28 and holes 30, 32 that are located proximate to end 28. End 26 of the membrane 22 is coupled to the rear frame portion 110. End 28 is releasably coupled to the front frame portion 140.

As shown in FIG. 2, the upper end 158 of the support member 146 is inserted through hole 30. Similarly, the upper end 160 of support member 148 is inserted through hole 32. Membrane 22 is supported on the second planar portions 154, 156 of each support member 146, 148.

In the illustrated embodiment, the membrane 22 is darted at regions 33 on either side of the seat portion 20. A triangular notch is cut in membrane 22 in each region 33. The membrane 22 is collected together to close the notch, thereby causing the membrane 22 to form a cup-like shape as illustrated in FIG. 1. The straps 34, 36 are secured to the membrane 22 in regions 33 to cover up the notch and to reinforce regions 33. The straps 34, 36 are also coupled to the membrane 22 to provide support to the seat portion 20. In the illustrated embodiment, strip 24 and straps 34, 36 are sewn to the membrane 22. However, the components of seat portion 20 can be coupled together using any known method of coupling items.

The term "membrane" is used herein to include, but is not limited to, a layer of material. For example, the membrane can be a piece of fabric such as nylon or neoprene.

In the illustrated embodiment, the support 10 includes tension members 40, 70 that are coupled to the frame 100. While the tension members 40, 70 are illustrated as substantially similar, the tension members do not have to be similar. Similarly, it is not necessary that the support has two tension members. Only one tension member will be discussed in detail below to simplify the description of the invention.

In the illustrated embodiment, the tension member is an elongated fabric strap. Alternatively, the strap can be a rope, cord, webbing, or any other structure that can provide a tensile force.

In the illustrated embodiment, the tension member includes a padded portion 42, and a strap portion 60. Tension member 40 is coupled to the rear frame portion 110 and the front frame portion 140.

One end of tension member 40 includes a hole 48 through which support member 112 is inserted. Accordingly, the tension member 40 is slidably coupled to the support member 112 of the rear frame portion 110. The opposite end of the tension member 40 is connected to the front frame portion 140 at front foot 162.

Figure 4:
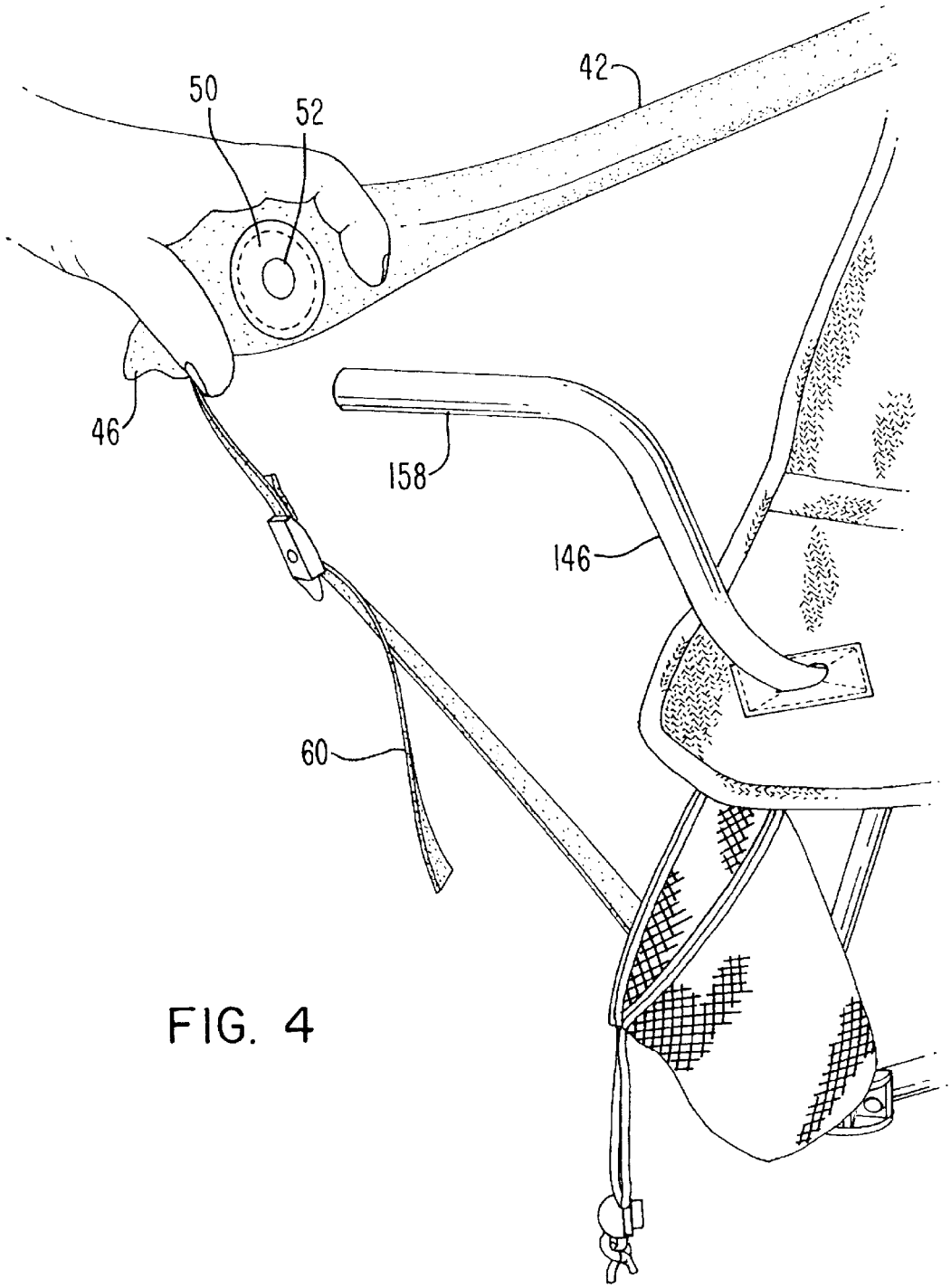
FIG. 4 illustrates a portion of a tension member of the support of FIG. 1.

In the illustrated embodiment, the tension member 40 is releasably coupleable to the front frame portion 140. As illustrated in FIG. 4, the padded portion 42 of the tension member 40 includes ends 44, 46 and a coupler 50 having an opening or hole 52 therein. Coupler 50 and hole 52 are located proximate end 46. The hole 52 is configured to receive a portion of the upper end 158 of the support member 146. Upper end 158 is inserted into and is seated in coupler 50.

Figure 5:
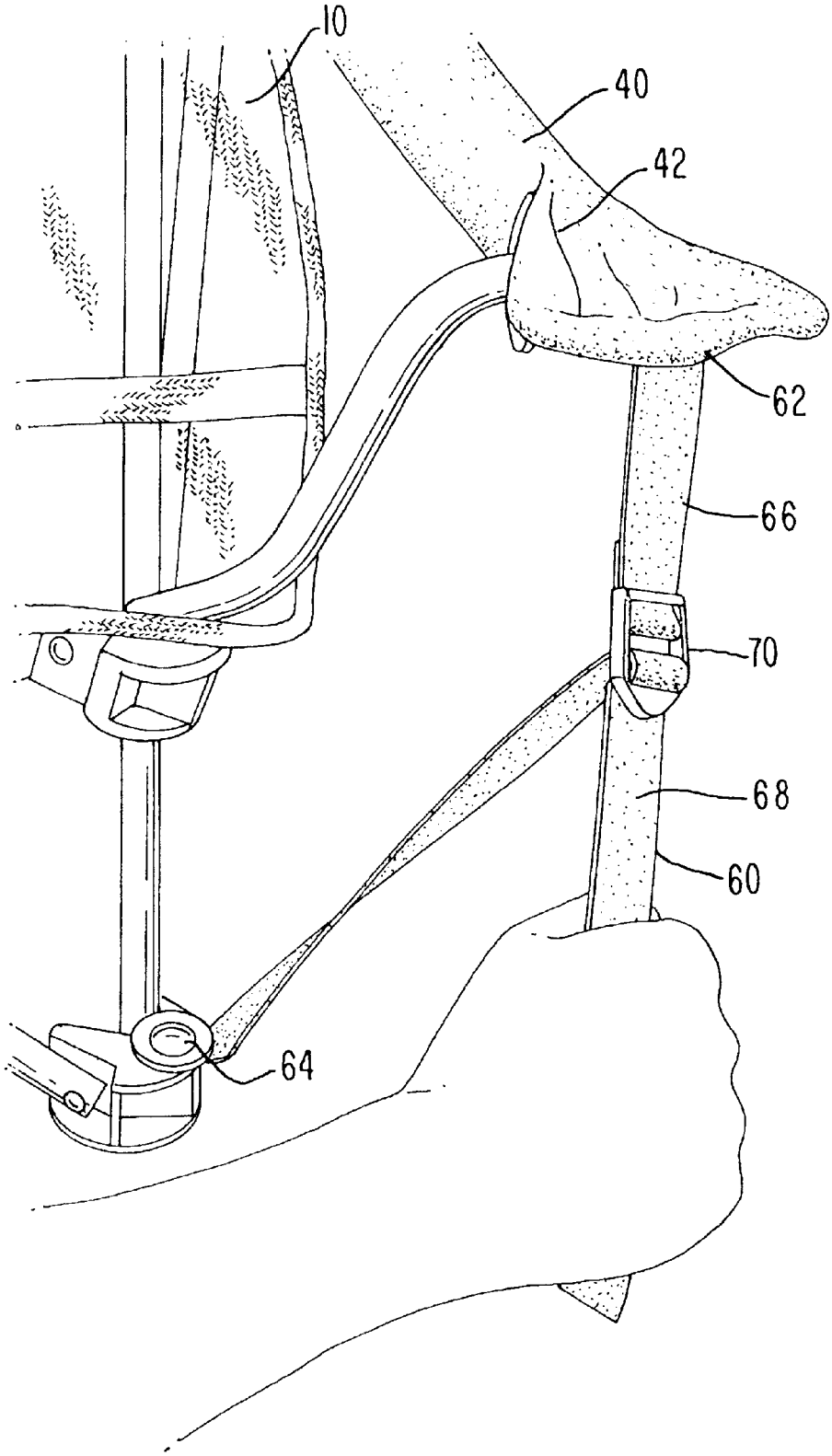
FIG. 5 illustrates a portion of a tension member of the support of FIG. 1.

As illustrated in FIG. 5, the strap portion 60 of tension member 40 includes ends 62, 64, a fixed portion 66, and an adjustable portion 68. One end 62 of the strap portion 60 is coupled to end 46 of the padded portion 42. The strap portion 60 also includes a tensioner 70 that couples the fixed portion 66 to the adjustable portion 68. Tensioner 70 can be adjusted to change the length of the strap portion 60.

In the illustrated embodiment, tensioner 70 is a buckle that is coupled to a free end of the fixed portion 66. Tensioner 70 can be any mechanism that can be used to retain two points on the strap portion together to vary the distance between the ends of the strap portion. For example, tensioner 70 can include a pair of buckles, a pair of clips, hook and loop fasteners, etc.

In an alternative embodiment, adjustment of the tension member can adjust the disposition of the frame. For example, the coupler can be sized to permit movement of the tension member relative to the upper end of the support member. Since the tension member is coupled to the rear frame portion, the tension member and the rear frame portion are pulled forwardly as the strap portion is shortened. When the rear frame portion is pulled forwardly, the angle that the rear frame portion is reclined relative to the supporting surface varies. Accordingly, the user can adjust the recline position of the support by adjusting the strap portion of the tension member.

Figure 6:
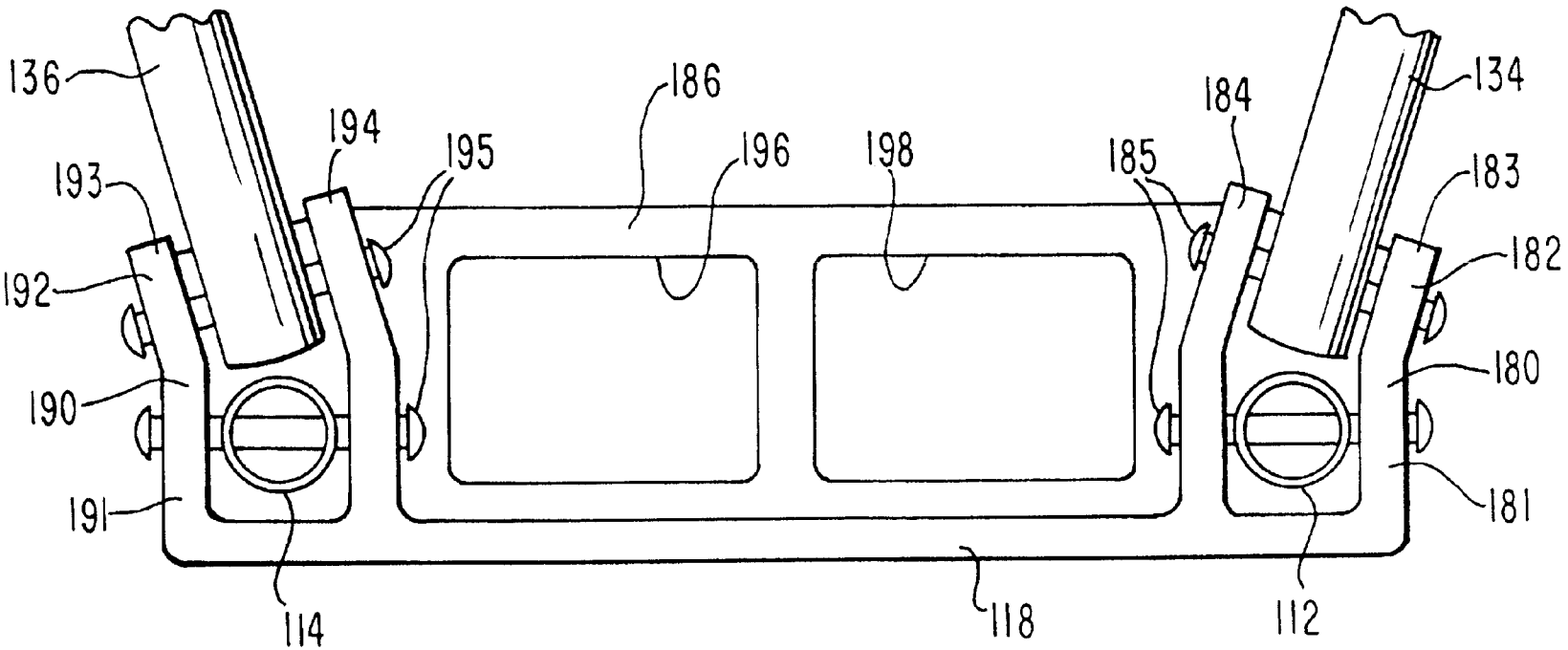
FIG. 6 illustrates a bottom coupler of the rear frame portion of the support of FIG. 1.

An embodiment of a lower coupler is illustrated in FIG. 6. Lower coupler 118 includes mounting portions 180, 190 and a bottom portion 186. In the illustrated embodiment, the mounting portions 180, 190 and the bottom portion 186 are integrally formed.

Mounting portions 180, 190 include side walls 183, 184 and 193, 194, respectively. Mounting portion 180 includes coupling portions 181, 182. Coupling portion 181 can be referred to as straight section or portion 181. Coupling portion 182 can be referred to as angled section or portion 182. As illustrated in FIG. 6, coupling portion 181 is oriented at an angle relative to coupling portion 182. Similarly, mounting portion 190 includes coupling portions or straight section 191 and angled section 192.

As illustrated in FIG. 6, rear support members 112, 114 are coupled to mounting portions 180, 190 by fasteners 185, 195, respectively. Fasteners 185, 195 can be any type of fastener that allows relative movement between the rear support members and the lower coupler.

Side support members 134, 136 are coupled to mounting portions 180, 190 by fasteners 185, 195. In the illustrated embodiment, the side support members 134, 136 are coupled to the angled sections 182, 192 of the mounting portions 180, 190. Rear support members 112, 114 are coupled to the straight sections 181, 191 of the mounting portions 180, 190.

When the frame is moved from its expanded configuration to its collapsed configuration, side support members 134, 136 pivot about fasteners 185, 195 in different planes. Since the angled sections 182, 192 are oriented at angles with respect to the coupler 118 as shown in FIG. 6, the planes in which the side support members 134, 136 move intersect each other.

Since the connections of the side support members 134, 136 to the lower coupler 118 are in front of and at angles to the connections of the rear support members 112, 114 to the lower coupler 118, the torque on the connections at the lower coupler 118 generated by the collapsing of the frame 100 is lower than the torque generated in conventional supports. Similarly, since the fasteners connecting a side support member and a rear support member to a particular mounting portion are not parallel, the torque generated in the fasteners during the collapsing or expanding of the frame is reduced.

The bottom portion 186 of the lower coupler 118 includes openings 196, 198. When the support 10 is placed on a surface with loose material, such as sand or dirt, the loose material can pass through openings 196, 198.

Figure 7:
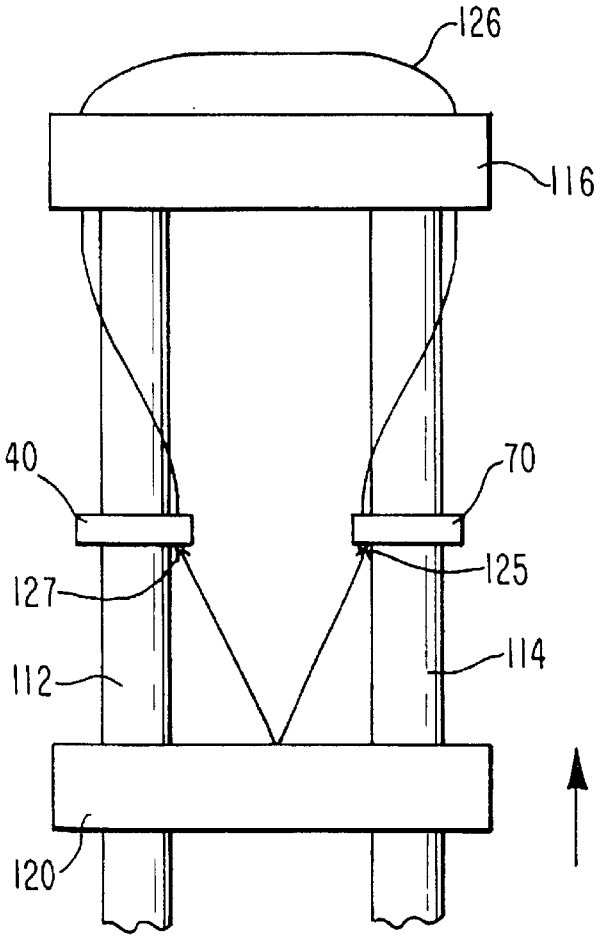
FIG. 7 illustrates a front view of a portion of the rear frame portion of the support of FIG. 1.

FIG. 7 illustrates a front view of an embodiment of the upper portion of the rear frame portion. The extension member 126 is coupled to the slide plate 120 and extends through openings in the upper coupler 116. The extension member 126 also passes through openings in the tension members 40, 70 behind the holes through which the rear support members 112, 114 extend.

In one embodiment, the extension member 126 includes two knots 125, 127. Each knot 125, 127 is positioned below and provides support for the end of one of the tension members 40, 70. Above the tension members 40, 70, the extension member 126 warps around each of the rear support members 112, 114 and passes through openings in the upper coupler 116 on the outside of the support members 112, 114. The operation of the extension member is discussed in greater detail below in FIGS. 16–18.

Figure 8:
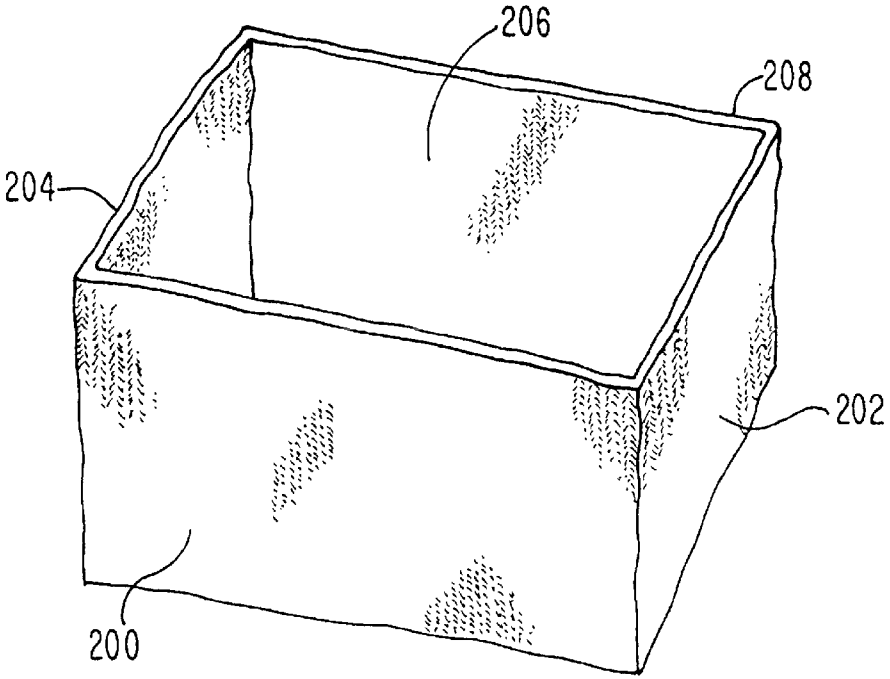
FIG. 8 illustrates a cover according to an embodiment of the invention.

An embodiment of a cover is illustrated in FIG. 8. Cover 200 includes a membrane 202 having an edge 204 that defines an opening 206. An elastic band 208 is sewn along edge 204. In the illustrated embodiment, the membrane is a nylon material.

FIGS. 9–15 illustrate a process, in ascending order, according to an embodiment of the present invention, by which a collapsible support can be changed or transformed from an expanded configuration to a collapsed configuration. It should be understood that the process can be reversed to transform the support from its collapsed configuration to its expanded configuration by following FIGS. 9–15 in reverse order.

Figure 9:
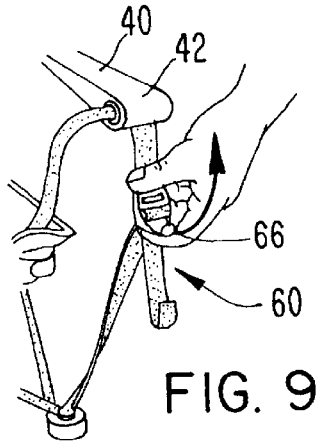
FIGS. 9–15 illustrate a process, according to an embodiment of the present invention, by which the support can be transformed from an expanded configuration to a collapsed configuration.
Figure 10:
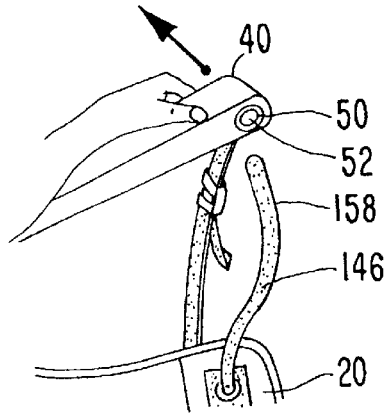

As shown in FIG. 9, the user releases the tension in the tension member 40 by increasing the length of the strap portion 60. The user then removes or decouples the upper end 158 of the support member 146 from the tension member 40 as illustrated in FIG. 10. These steps, releasing the tension and removing the tension member 40, are repeated for the second tension member 70.

Figure 11:
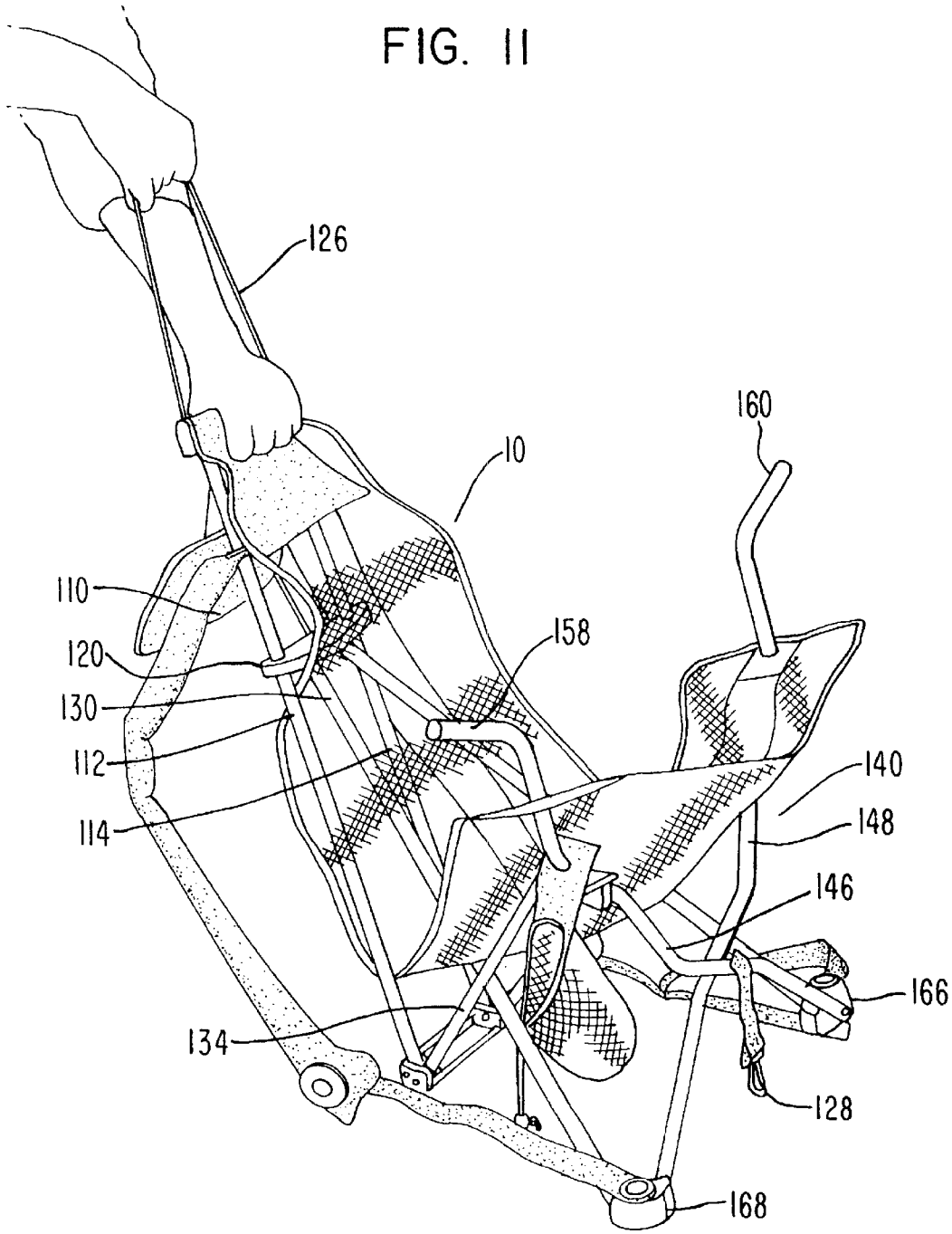
Figure 12:
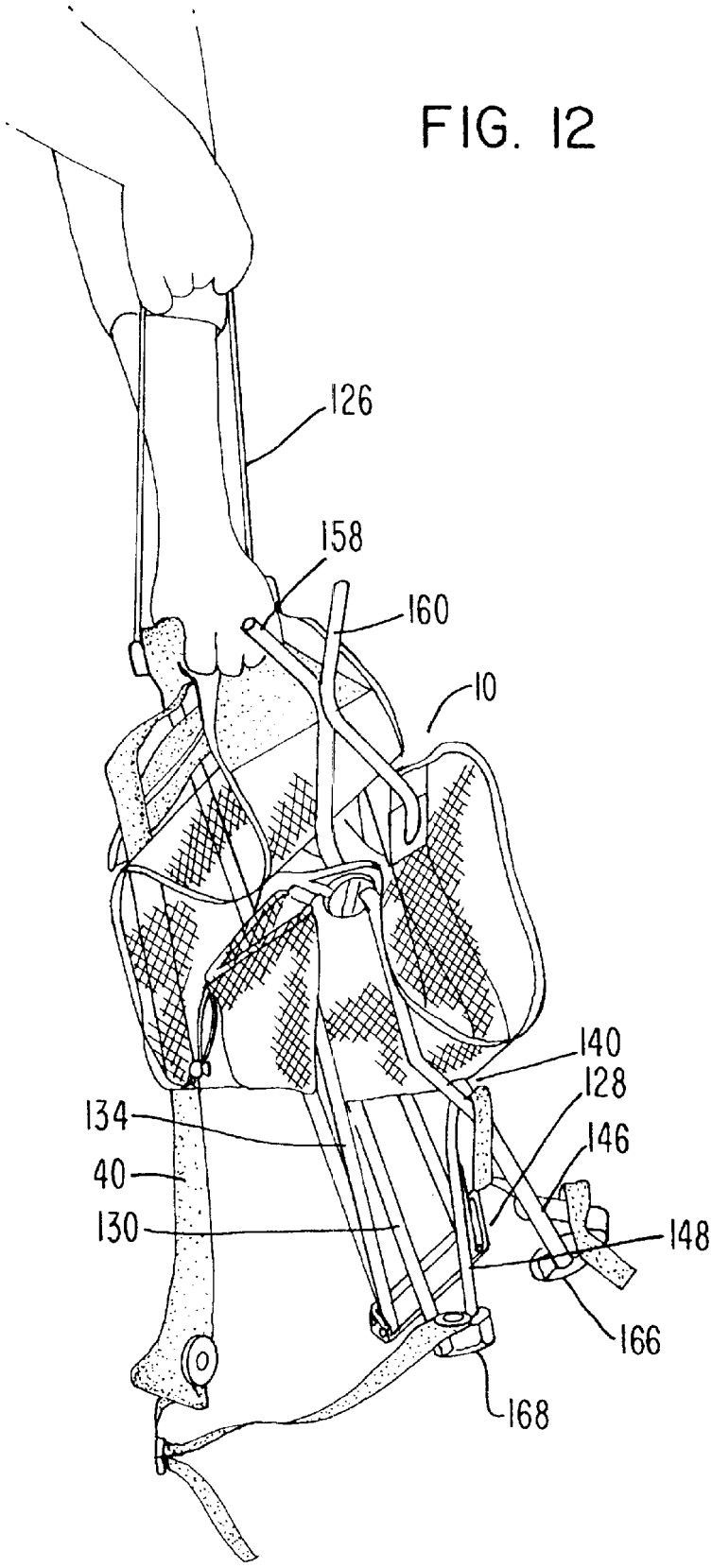

As shown in FIGS. 11–12, the user grasps and pulls upwardly on the cord 126 while holding onto the upper coupler 116. When the user pulls the cord 126, the slide plate 120 slides upwardly along support members 112, 114. As the slide plate 120 moves upwardly, the ends of the support members 130, 132 connected to the slide plate 120 move upwardly. As a result, the lower ends of the upper side support members 130, 132 are drawn toward the rear frame portion 110 and the lower side support members 134, 136 pivot about their lower ends. The scissor-like movement of the side support members 130, 132, 134, 136 draws the front frame portion 140 towards the rear frame portion 110. The movement also causes the front feet 162, 164 to move together and the upper ends 158, 160 to move together.

Figure 13:
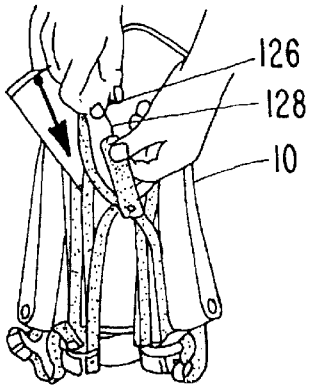

Once the frame 100 is collapsed, the user then secures the support 10 in its collapsed configuration by fastening the clip 128 that is coupled to the front frame portion 140 to cord 126 as illustrated in FIG. 13.

Figure 14:
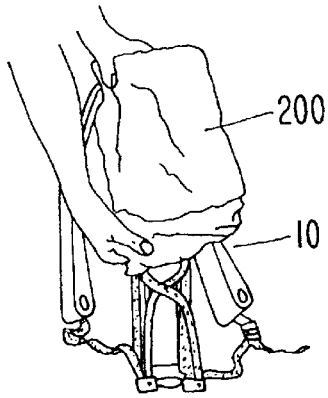
Figure 15:
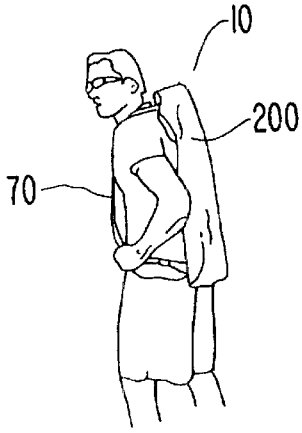
Figure 16:
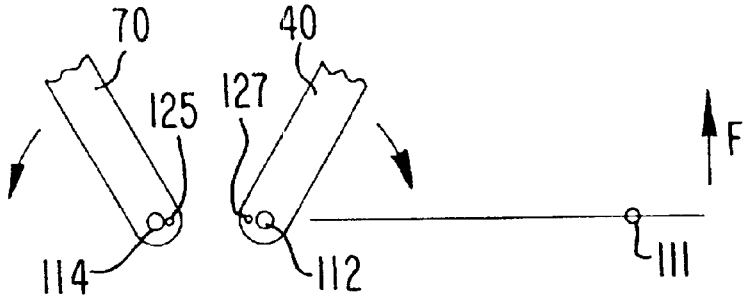
FIGS. 16–18 illustrate the movement of the tension members relative to the rear frame portion.
Figure 17:
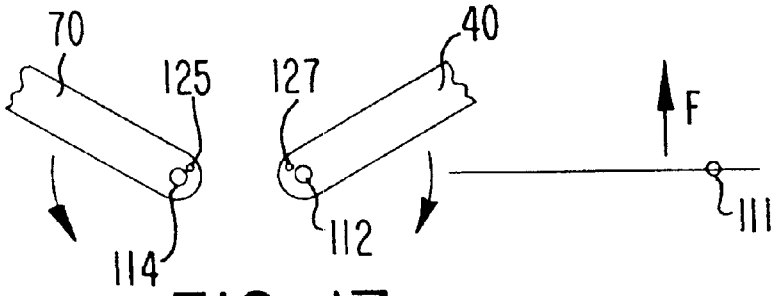
Figure 18:
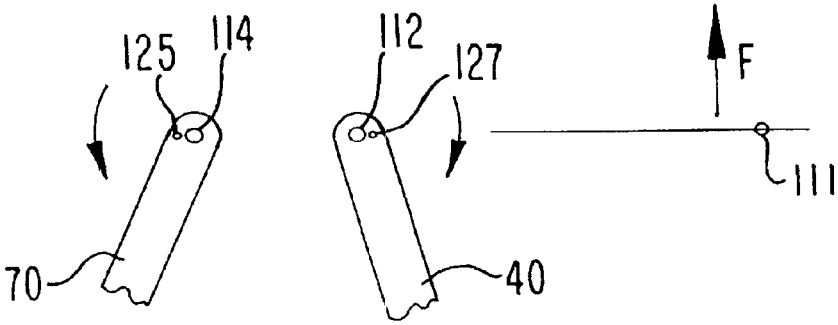

Cover 200 can be placed over the collapsed support 10 as illustrated in FIGS. 13–14. The cover 200 is configured to receive a portion of the collapsed support 10. In particular, the cover 200 encloses a portion of the frame 100. The tension members 40, 70, however, are not enclosed by and extend from the cover 200. As illustrated in FIG. 15, the tension members 40, 70 can be supported on the shoulders of the user. FIGS. 16–18 illustrate the rotation of the tension members during the collapsing of the frame. Line 111 represents a plane defined by the rear support members 112, 114. The direction in which the support 10 is facing is illustrated by the arrow F.

In FIG. 16, the support 10 is illustrated in its expanded configuration. As the user grasps the extension member 126 and pulls it upwardly, the tension members 40, 70 and the location of the knots 125, 127 rotate around the rear frame member 110. As illustrated in FIGS. 17 and 18, tension member 40 rotates around rear support member 112. Tension member 70 rotates in an opposite direction about rear support member 114. The rotation of the tension members 40, 70 is caused by the wrapping of the extension member 126 around each rear support member 112, 114.

Referring to FIG. 7, as the extension member 126 is pulled higher and advances upwardly along the rear frame portion 110, the relative positions of the knots 125, 127 move around the rear support members 112, 114. The wrapping movement of the extension member 126 around members 112, 114 causes the tension members 40, 70 to move between a position in which they provide support to a user's arm and a position on the rear of the frame 100 in which they can be carried on the shoulders of a user. The positions of the tension members 40, 70 relative to the frame 110 during the collapsing process are illustrated in FIGS. 11 and 12.

Figure 19:
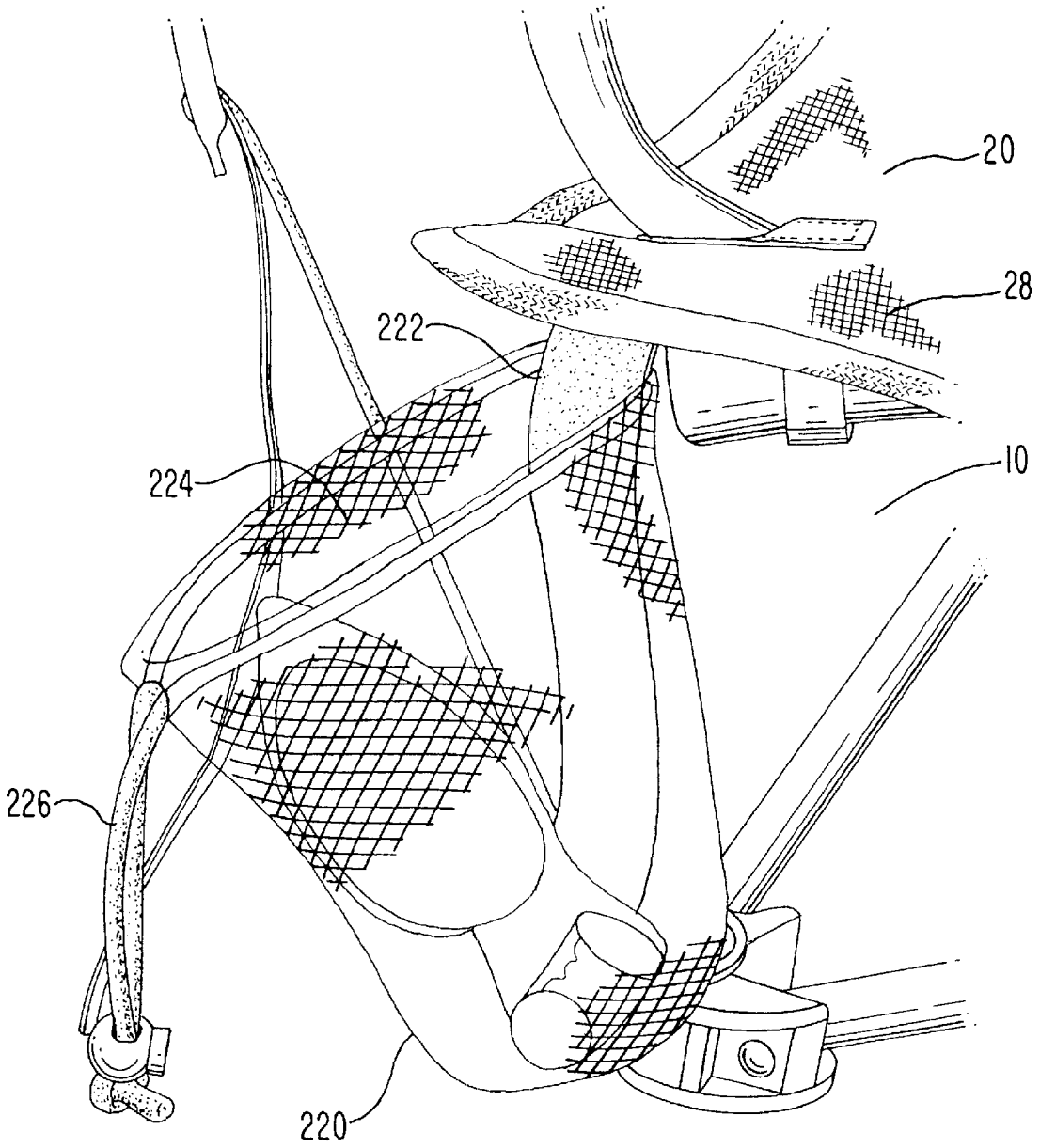
FIG. 19 illustrates a storage bag of the support of FIG. 1.

In one embodiment, the support 10 can include a pouch 220 as illustrated in FIG. 19. The pouch 220 is coupled proximate to the end 28 of the seat portion 20. The pouch 220 includes an attachment strap 222, a fabric portion 224, and a draw string 226. The attachment strap 222 is coupled to the seat portion 20 and supports the fabric portion 224 of the pouch 220. A draw string 226 is provided at the upper surface of the fabric portion 224 to close the opening 228.

While the illustrated fabric portion is made from a mesh material, the fabric portion can be any material that can be used to support and retain an article. Similarly, the fabric portion can be any size or shape that enables the pouch to hold articles.

Figure 20:
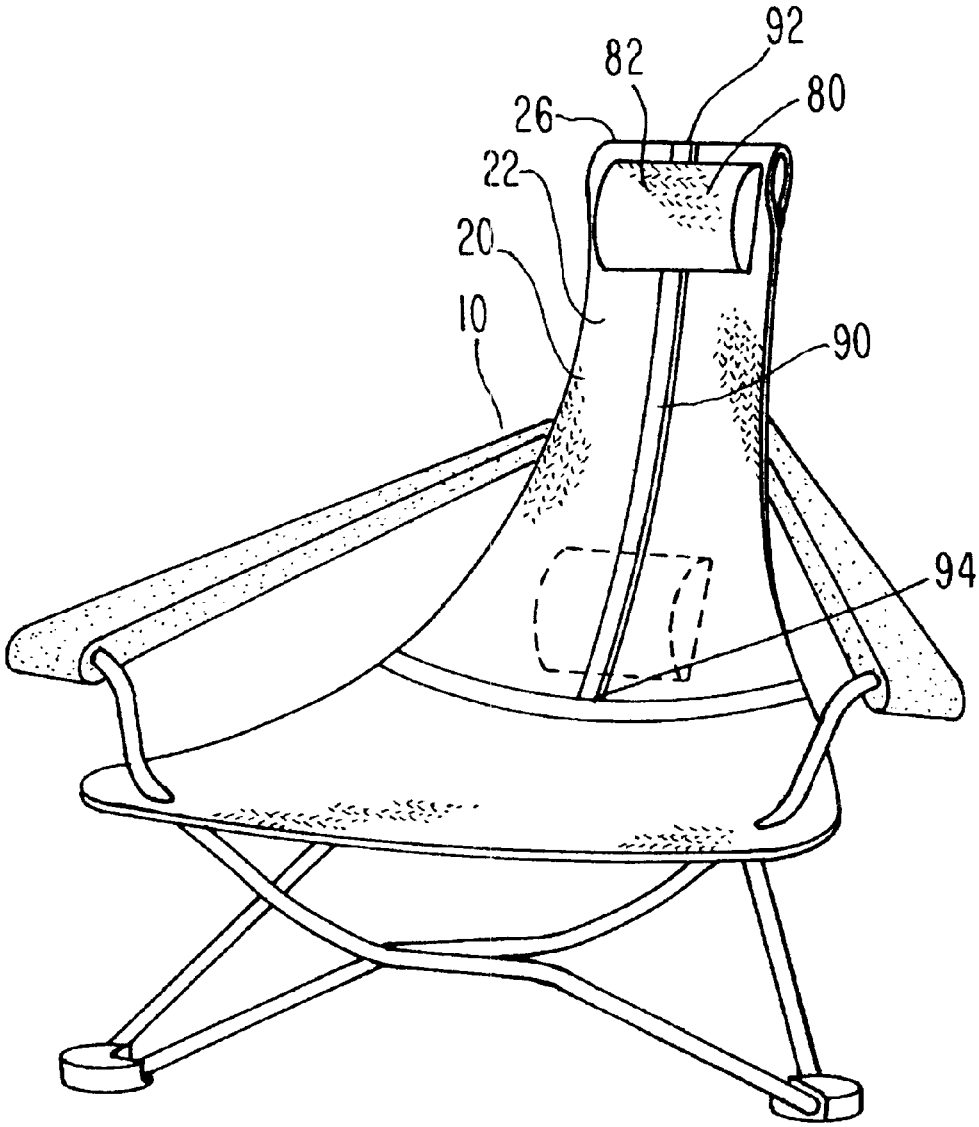
FIGS. 20–21 illustrate a support and a pillow according to an embodiment of the invention.
Figure 21:
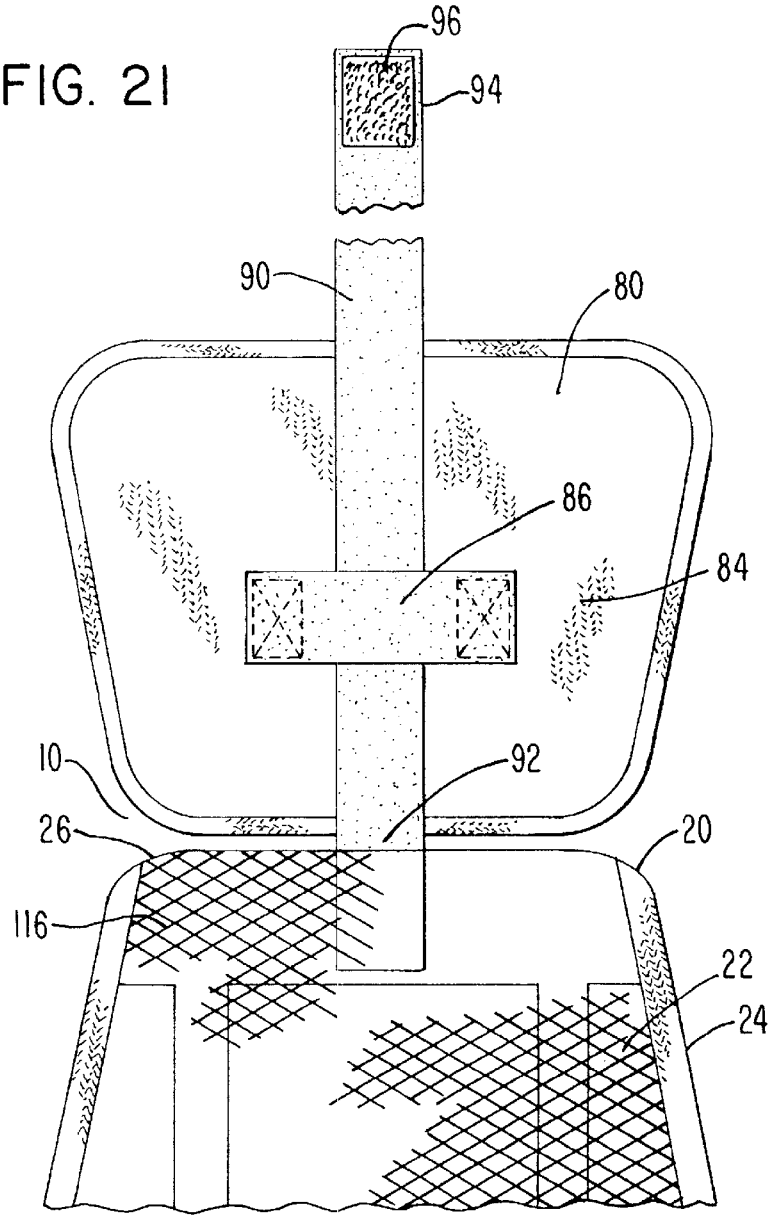

In one embodiment, the support 10 includes a pillow 80. As illustrated in FIGS. 20–21, the pillow 80 includes a body with a front surface 82 and a rear surface 84. The front surface 82 of the pillow 80 can be used to support a portion of a user's body, such as a head, neck, or back. The pillow 80 includes a fabric loop 86 mounted on its rear surface 84.

The pillow 80 is slidably coupled to an elongated strap 90 that extends along the back portion of the seat portion 20. Strap 90 is inserted into loop 86, thereby allowing the pillow 80 to slide a long strap 90. The pillow 80 can slide between upper and lower position as illustrated in FIG. 20. In the upper position, the pillow 80 is a head cushion for the support 10.

The strap 90 includes ends 92, 94. End 92 is coupled to end 26 of the membrane 22. The other end 94 of the strap 90 includes a fastener 96 and can be selectively attached to the membrane 22. In the illustrated embodiment, fastener 96 is a hook fastener that can be coupled to the membrane 22 of the seat portion. Thus, the pillow 80 can be disposed in a plurality of positions on the membrane 22 as determined by the strap 90.

In one embodiment, the strap 90 can be flipped over the upper coupler 116 and rest against or be secured to the back of the support 10. When the support 10 is collapsed, the pillow 80 can be positioned along strap 90 so that it is positioned between the frame 100 and the user when the support 10 is carried on the user's back.

Figure 22:
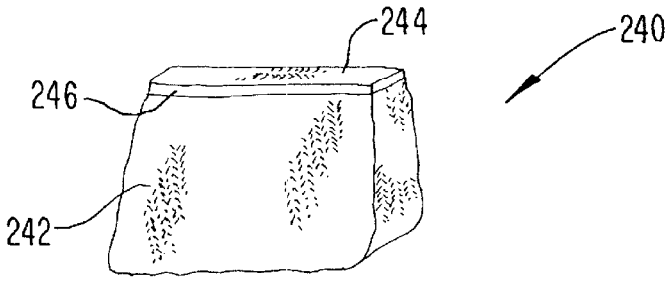
FIG. 22 illustrates an alternative embodiment of a pillow according to the present invention.

In the illustrated embodiment, the pillow is filled with a stuffing material. In an alternative embodiment, the pillow can be a pouch with a sealable opening into which material can be inserted. As illustrated in FIG. 22, pillow 240 may include a flexible membrane 242 that defines an opening 244. The pillow 240 can include a closing mechanism 246, such as a zipper or a hook and loop fastener, to close the opening 244. When the support 10 is in its expanded configuration, the cover 200 can be stuffed into the pillow 240 to enable the pillow 240 to be used as a support.

FIGS. 23–28 illustrate several alternative embodiments of shades that can be used with a support according to the present invention. Shades can be utilized with any type of support, including the support illustrated in FIGS. 1–3.

In the illustrated embodiments, each of the shades is releasably coupled to a support with tethering lines 314 and coupling elements 316. Coupling mechanisms other than tethering lines and coupling elements can be used to secure the shades to the supports. For example, straps with buckles, clips, or slide on pockets can be used. Alternatively, a shade can utilize sand anchors to position the shade relative to a chair, instead of coupling the shade to the chair.

Also, while the tethering lines are illustrated as secured to the shades via holes, the coupling mechanisms can be clipped, adhered, sewn, or connected to the shades using any other method of coupling items. The arrangement of the coupling mechanisms, including the holes on the shades, can vary depending on the desired arrangement.

Figure 23:
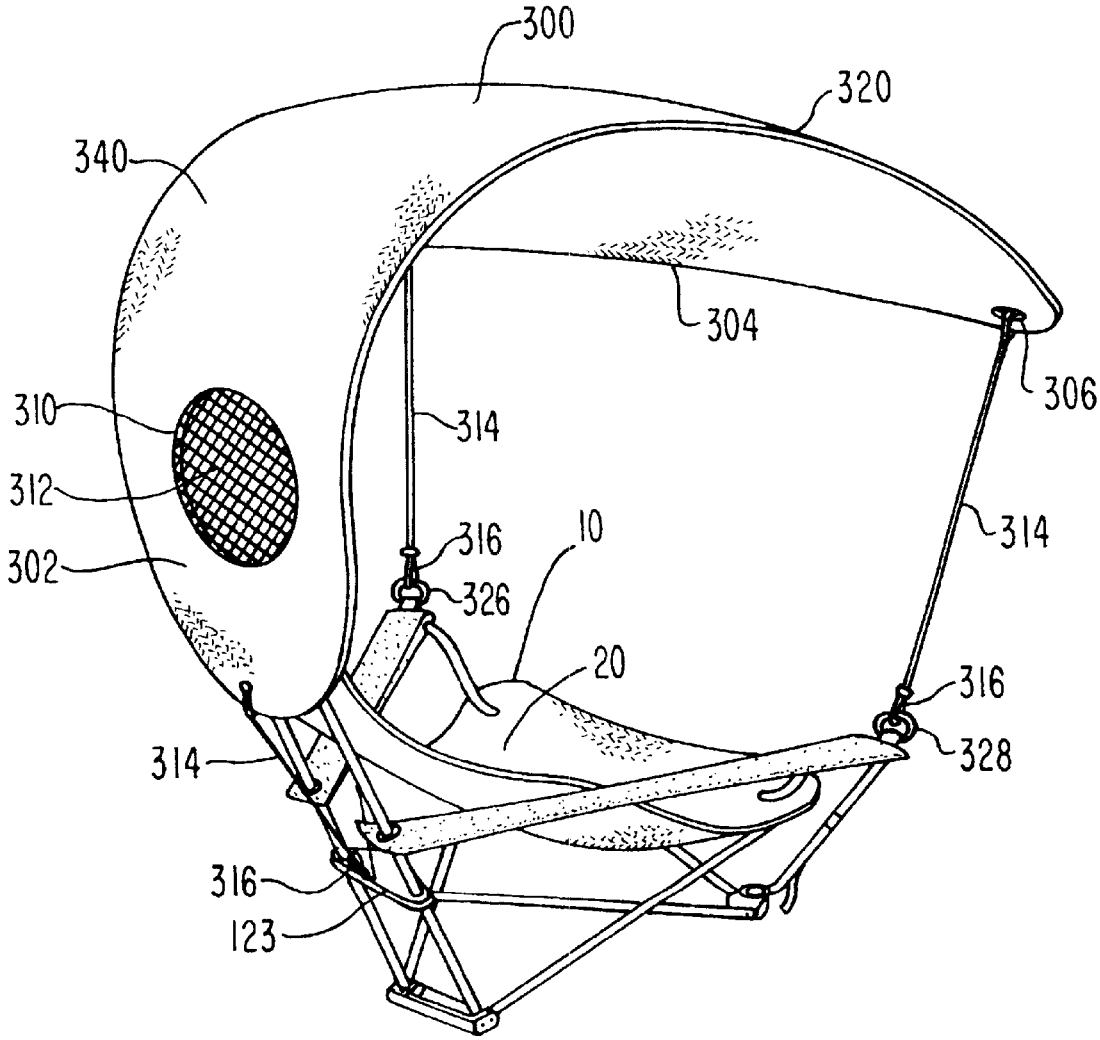
FIG. 23 illustrates a combination of a support and a shade according to the present invention.

In one embodiment, a support can include a shade 300 coupled thereto. In FIG. 23, shade 300 is coupled to the support 10 at three locations. Shade includes a membrane 340, a frame 320, and ends 302, 304. An opening 310 is formed in membrane 340 proximate to end 302. A fabric material 312, such as mesh, covers opening 310, which provides ventilation.

The membrane 340 is coupled to the frame 320 that provides support for the shade. In the illustrated embodiment, the frame 320 is a flexible band, such as a thin metal band. An example of a shade is disclosed in U.S. patent application Ser. No. 09/764,059, entitled "Collapsible Sunshade and Methods of Using the Same", filed Jan. 19, 2001, the disclosure of which is incorporated by reference herein.

The coupling mechanisms 316 are releasably secured to mounting elements that are connected to the support as illustrated. In one embodiment, the support 10 can include mounting elements 326, 328 located on the front frame portion 140.

Figure 24:
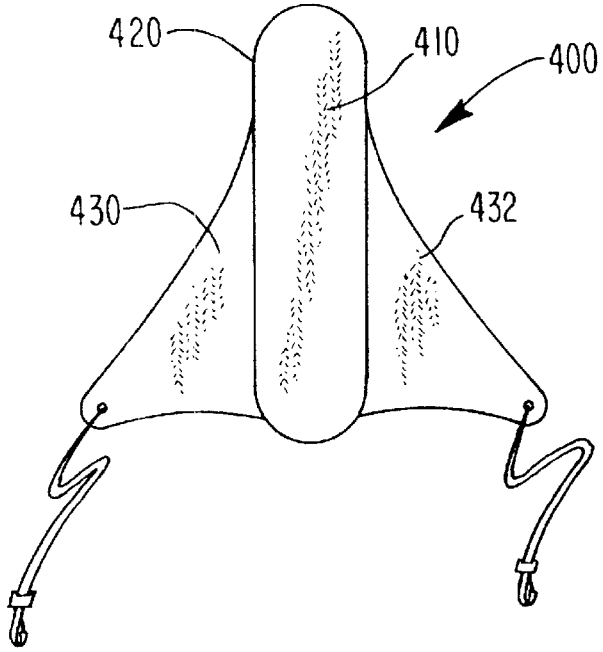
FIGS. 24–28 illustrate alternative embodiments of a shade according to the present invention.

As shown in FIGS. 23–28, the shape and features of the shade embodiments can vary. In FIG. 24, shade 400 includes a membrane 410, a frame member 420, and flaps 430, 432. The frame member 420 is a flexible metal band that provides support to the membrane 410. In this embodiment, the frame member 420 does not extend around the perimeter of the shade 400. The flaps 430, 432 are provided on the side of the center portion of the membrane 410.

Figure 25:
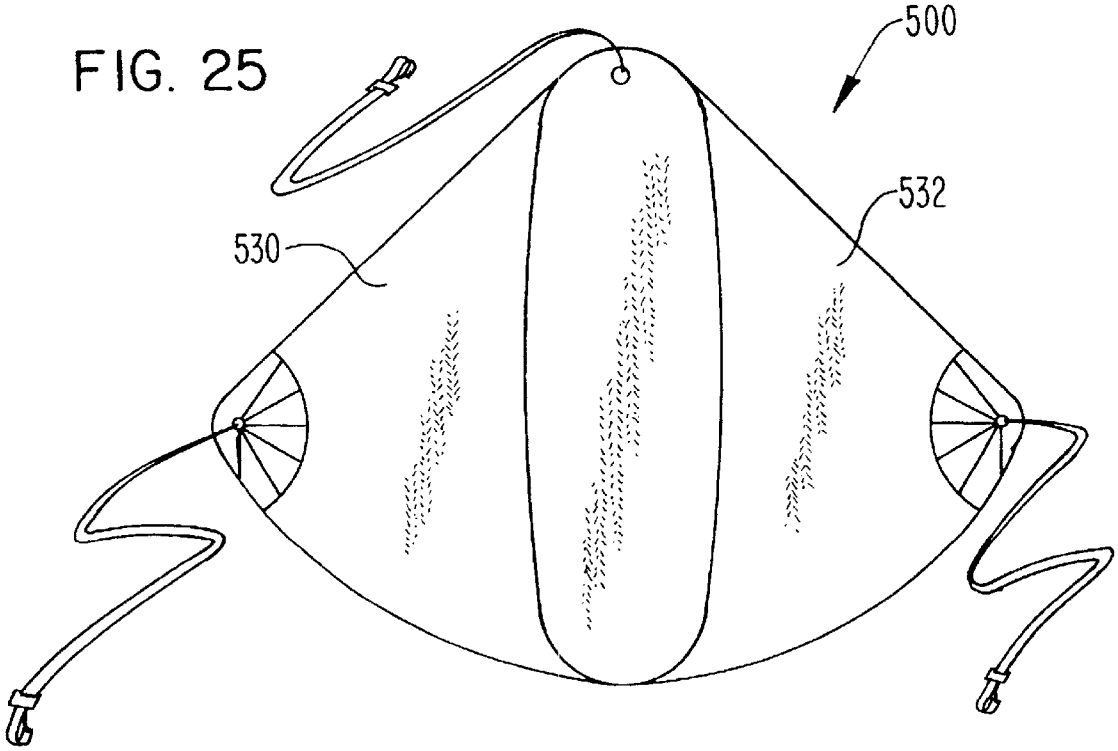
Figure 26:
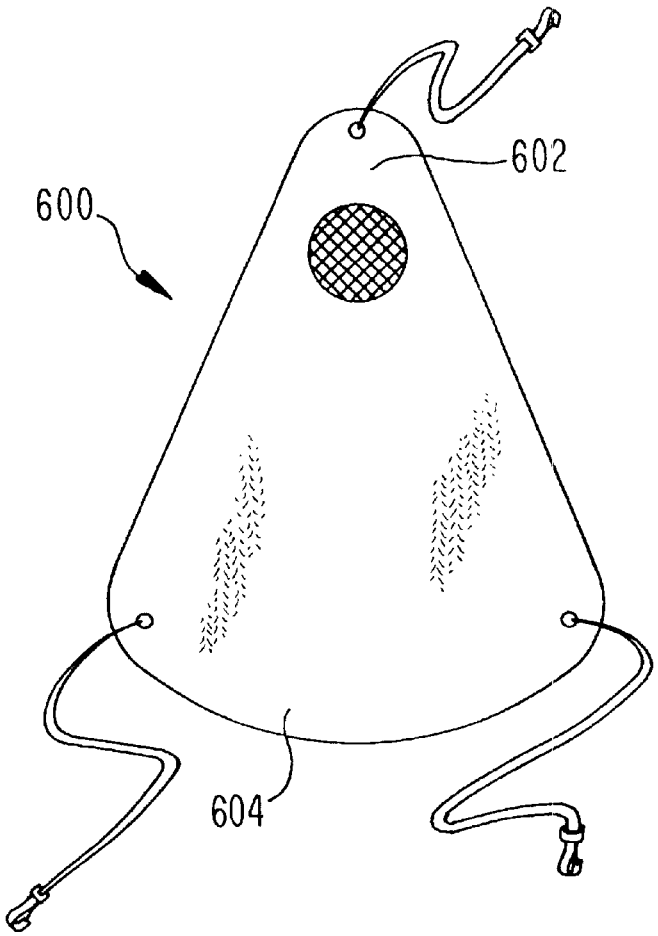
Figure 27:
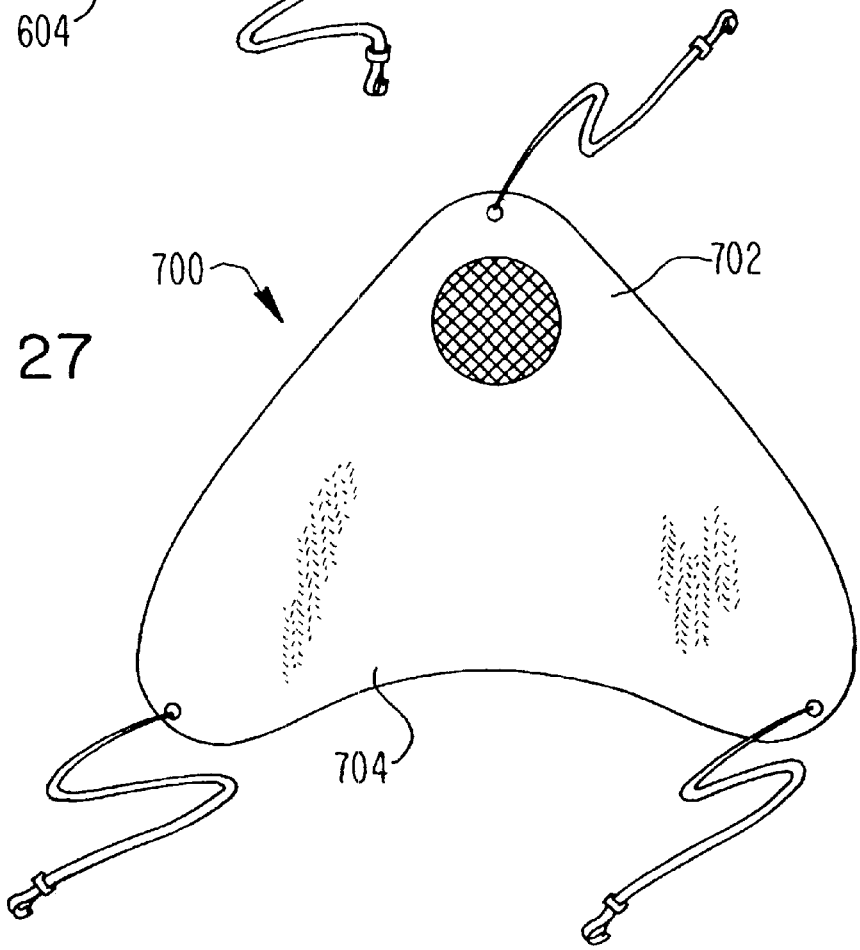

Additional embodiments of a shade are illustrated in FIGS. 25–28. In FIG. 25, shade 500 includes flaps 530, 532. Shade 500 is substantially similar to shade 400, which is shown in FIG. 19, with the exception of the shapes of the flaps. In FIG. 26, shade 600 includes ends 602, 604, one of which has an inwardly curved shape. In FIG. 27, shade 700 includes ends 702, 704, one of which has an outwardly curved shape.

Figure 28:
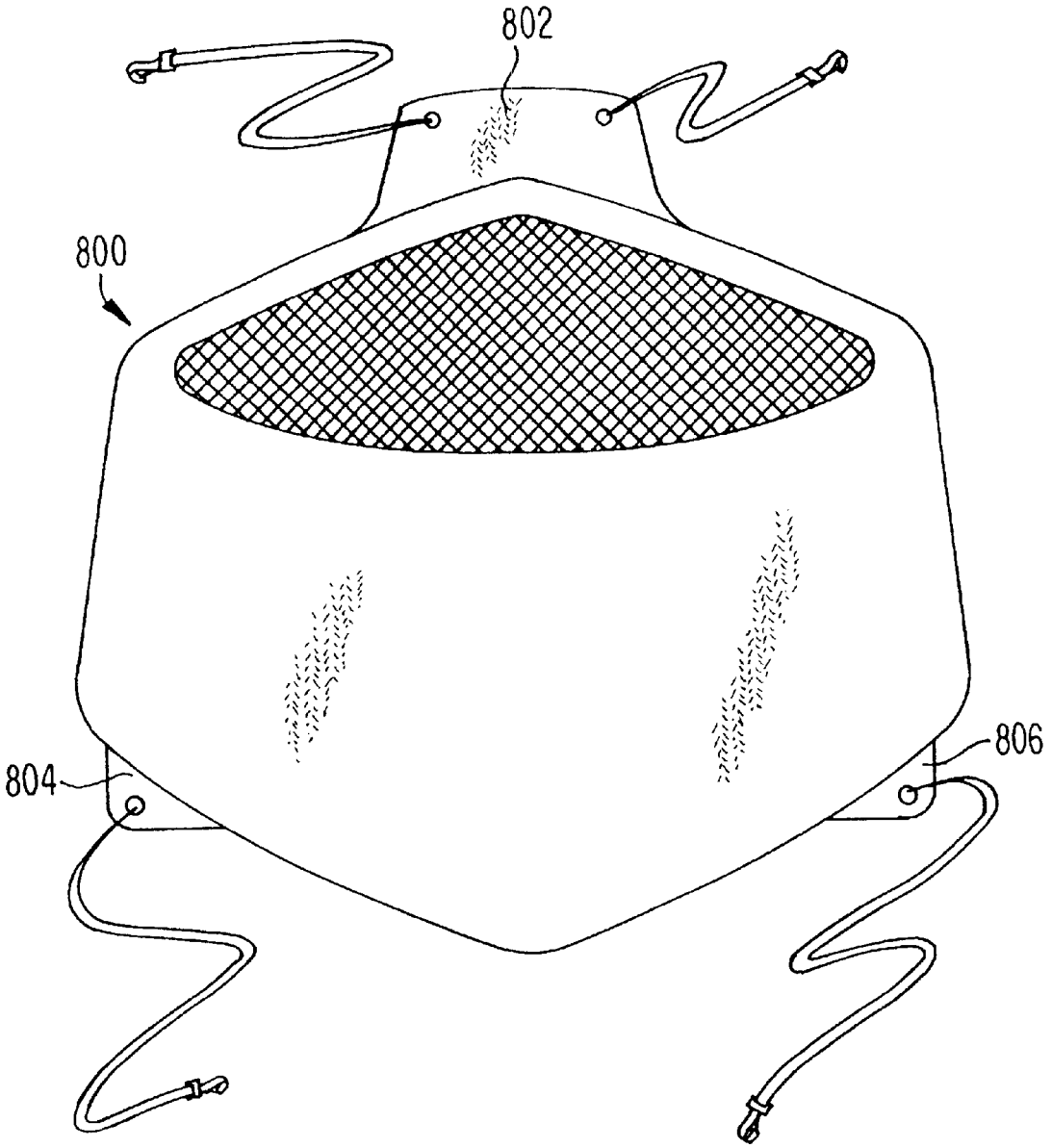

In FIG. 28, shade 800 has a hexagonal shape with several flaps 802, 804, 806 located on its perimeter.

The shapes of the shades, including the flaps, can be varied depending on the desired amount of protection from the sun, rain, etc. The frame member of a shade provides support and can be located in different portions of the shade, depending on the desired flexibility of the shade.

Figure 29:
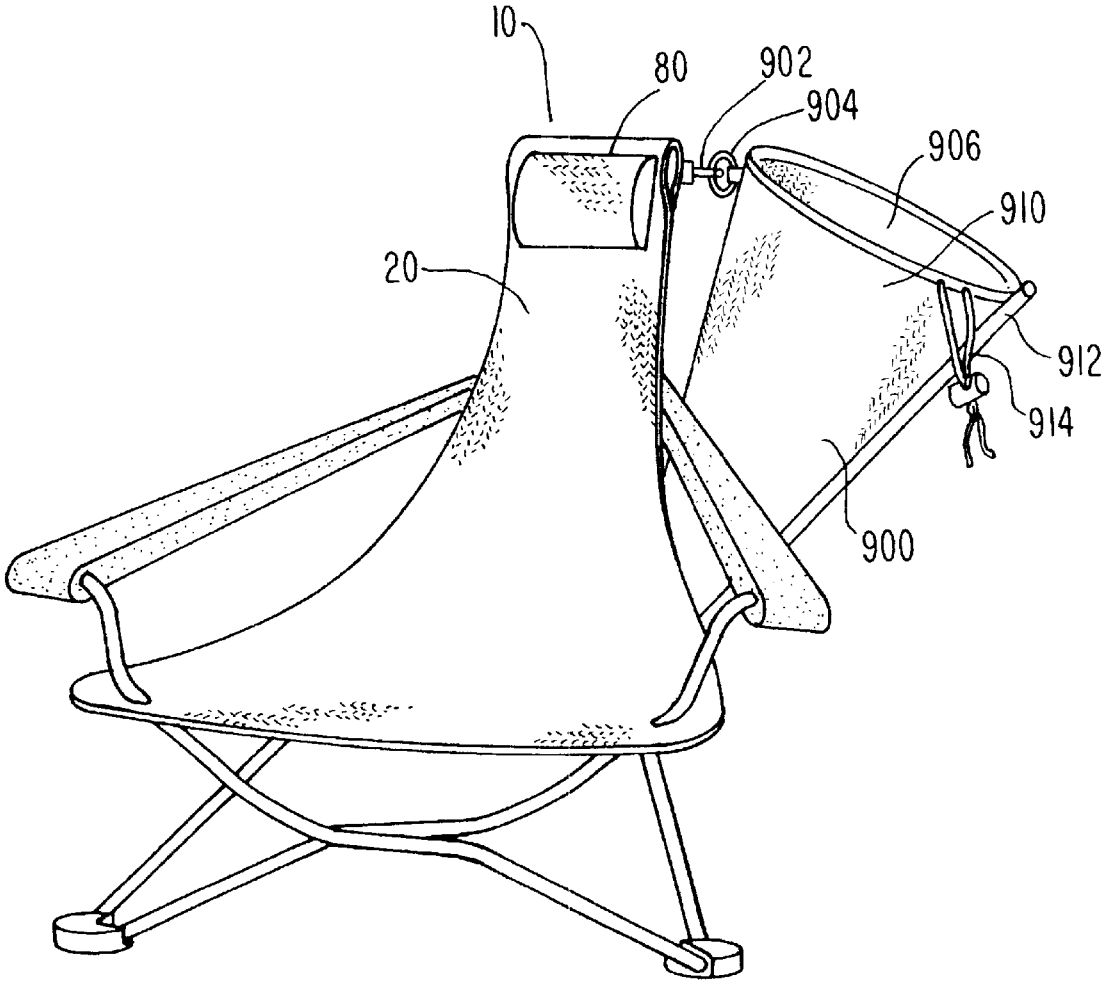
FIG. 29 illustrates an alternative embodiment of a support according to the present invention.

The support 10 can also include a storage bag 900 as illustrated in FIG. 29. The bag 900 includes a wall 910 that defines an opening 906 into which articles can be inserted. The opening 906 can be adjusted using a drawstring 914. The bag 900 includes a rod 912 along a portion of the wall 910. When the support 10 is in its expanded configuration the weight of the rod 912 causes the bag 900 to lean to one side of the support 10 to bias the bag 900 into an open position.

The support 10 is releasably coupled to the frame 100. In the illustrated embodiment, the support includes mounting element 904 that can be coupled to coupler 902 on the frame 100.

Alternatively, the support 10 can include a storage device 1000 as illustrated in FIGS. 30–33. The storage device 1000 includes mounting elements 1010, 1012, 1014, 1016, a mesh compartment 1030, a cooler compartment 1034, and pockets 1040, 1042, 1044. The support 10 includes couplers 1020, 1022, 1024, 1026 that can interact with the mounting elements 1010, 1012, 1014, 1016 to releasably couple the storage device 1000 to the support 10. For example, the storage device 1000 can be supported on the frame 100 when it is connected to primary mounting elements 1010, 1012, and one or both of the secondary mounting elements 1014, 1016.

Figure 30:
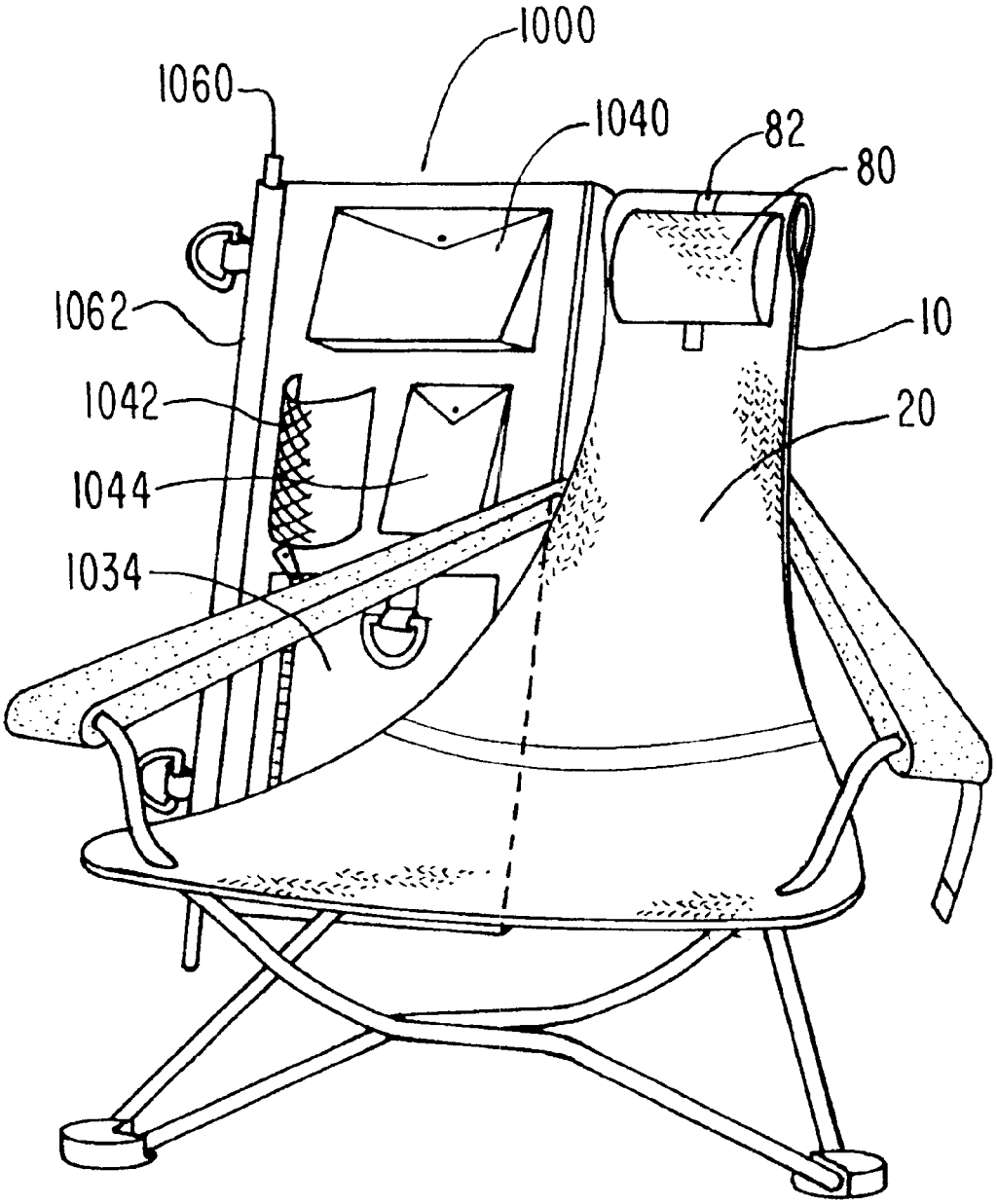
FIGS. 30–32 illustrate a combination of a support and a storage device according to the present invention.

As illustrated in FIG. 30, when the support 10 is in its expanded configuration, the storage device 1000 can be positioned on one side of the support 10 to allow for easy access to the cooler compartment 1034 and the pockets 1040, 1042, 1044.

Figure 31:
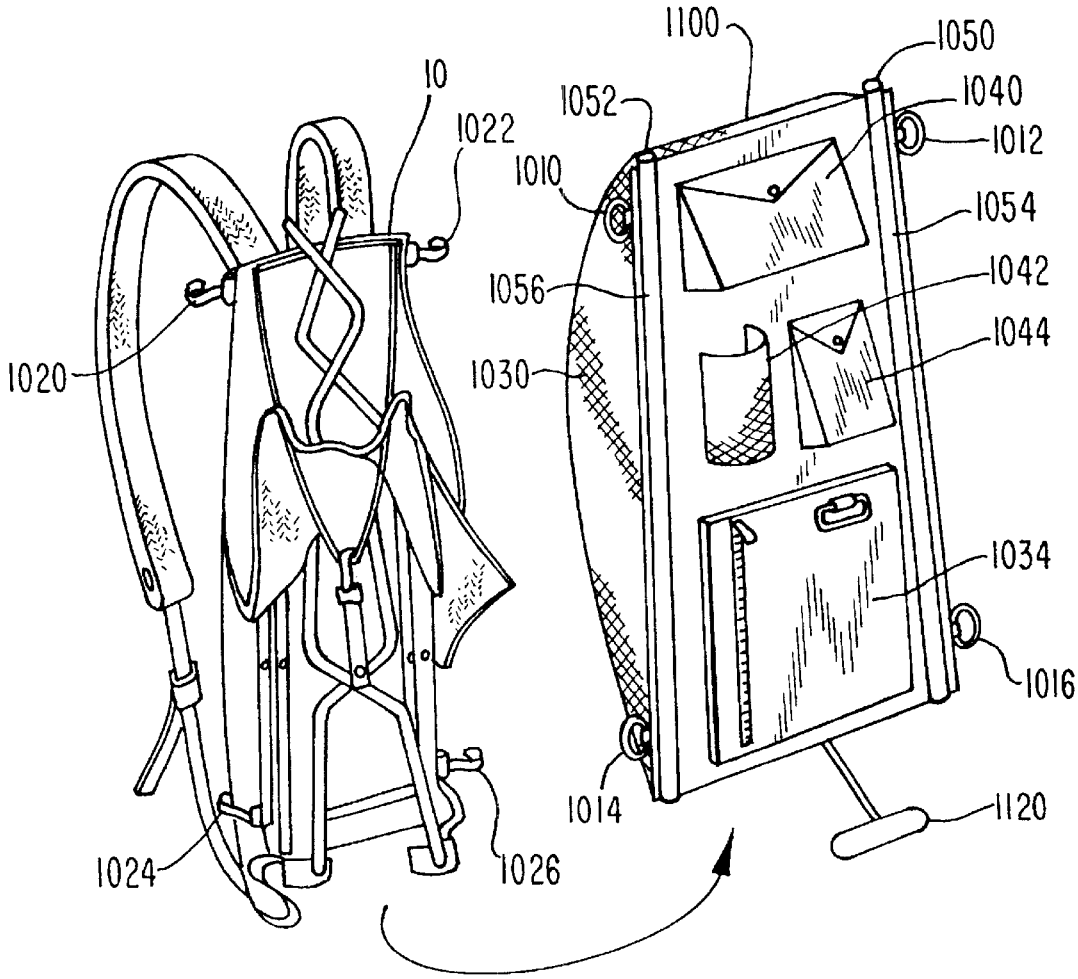
Figure 32:
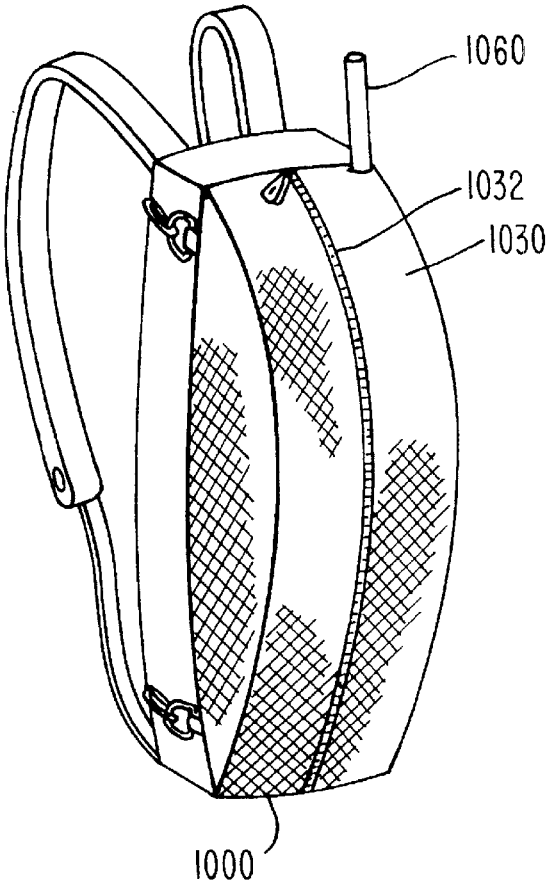
Figure 33:
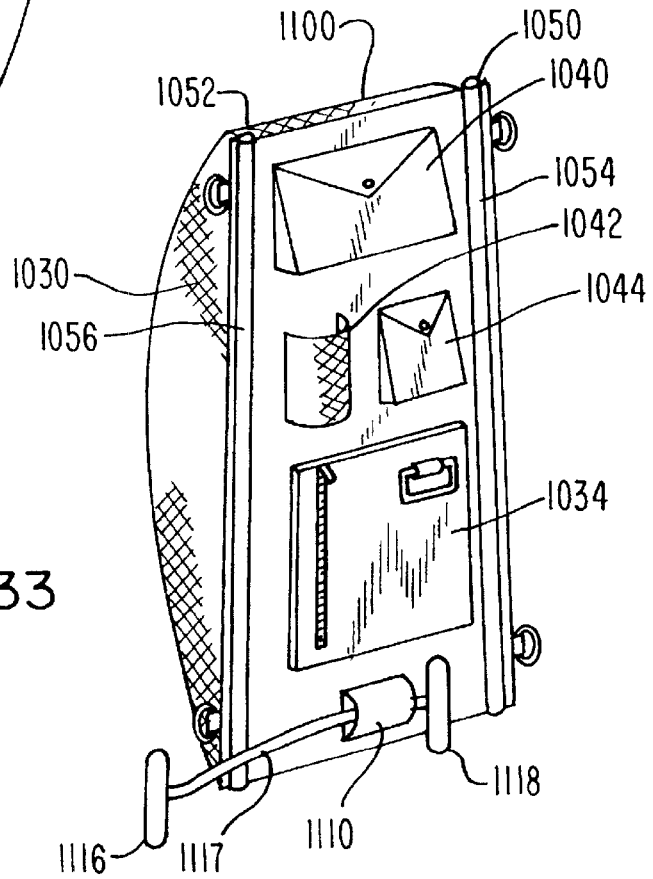
FIG. 33 illustrates an alternative embodiment of a storage device according to the present invention.

As illustrated in FIGS. 31–32, when the support 10 is in its collapsed configuration, the storage device 1000 can be coupled to the support 10 opposite the tension members 40, 70. The connection of the storage device 1000 and the support 10 allows for easy transportation of the storage device 1000 with the support 10.

In one embodiment of the storage device 1000, as illustrated in FIGS. 30 and 32, the storage device 1000 includes a stake 1060 and a sleeve 1062. The stake 1060 is stored in the sleeve 1062 when the support 10 is in its collapsed configuration.

The stake 1060 can extend through the sleeve 1062 when the support 10 is in its expanded configuration. When the stake 1060 extends from the sleeve 1062, the stake 1060 engages a support surface to provide support for the storage compartment 1000.

As illustrated in FIG. 31, storage device 1100 includes frame members 1050, 1052 and an anchor 1120. The frame members 1050, 1052 are mounted in sleeves 1054, 1056 and provide rigidity to the storage device 1110. The anchor 1120 can be used to support the storage device 1100 when the support 10 is in its expanded configuration.

The anchor 1120 can be releasably coupled to the frame members as illustrated in FIG. 31, or can be coupled at any point along the bottom or side of the storage device 1100.

In one embodiment, two anchors 1116, 1118 can be coupled to a single strap 1117 that is slidably threaded through loop 1111. In one embodiment, the storage device can include two or more loops through which the strap is threaded. Depending on the orientation of the storage device 1100, anchor 1116 or anchor 1118 can be pulled out to one side to be engaged with a supporting surface and to secure the storage device 1100. Strap 1117 can be any flexible, elongated member that can be positioned along the storage device 1110.

Many possible variations on the particular embodiments described above would be consistent with the principles of the invention. Several additional variations are described below.

Figure 34:
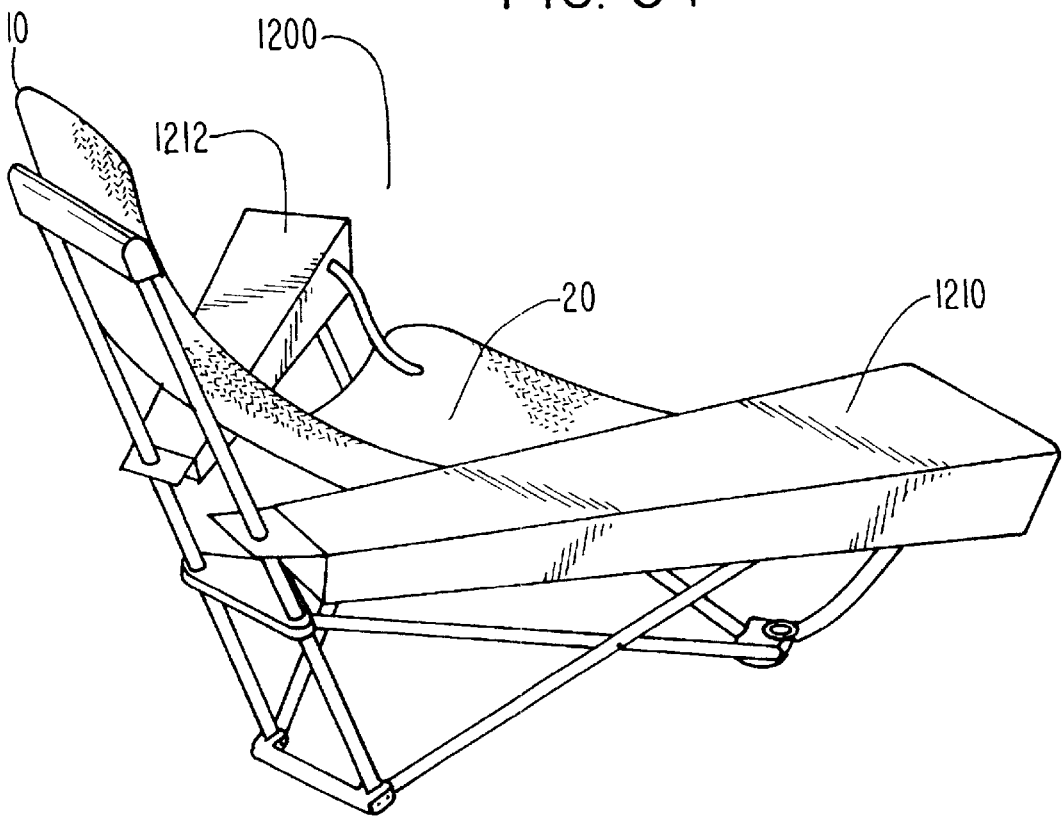
FIG. 34 illustrates an alternative embodiment of a support according to the present invention.

In one embodiment, the support 1200 can include floatation devices. As illustrated in FIG. 34, support 1200 includes floatation devices 1210, 1212 coupled to the tension members 40, 70. Additional floatation devices can be coupled to the support 10 at different locations to increase the buoyancy of the support 1200. For example, a floatation device can be positioned beneath part of the seat portion.

In the illustrated embodiment, floatation devices are inflatable members that are coupled to the tension members. The floatation devices can be any device that can float (i.e., has a density less than that of water).

Figure 35:
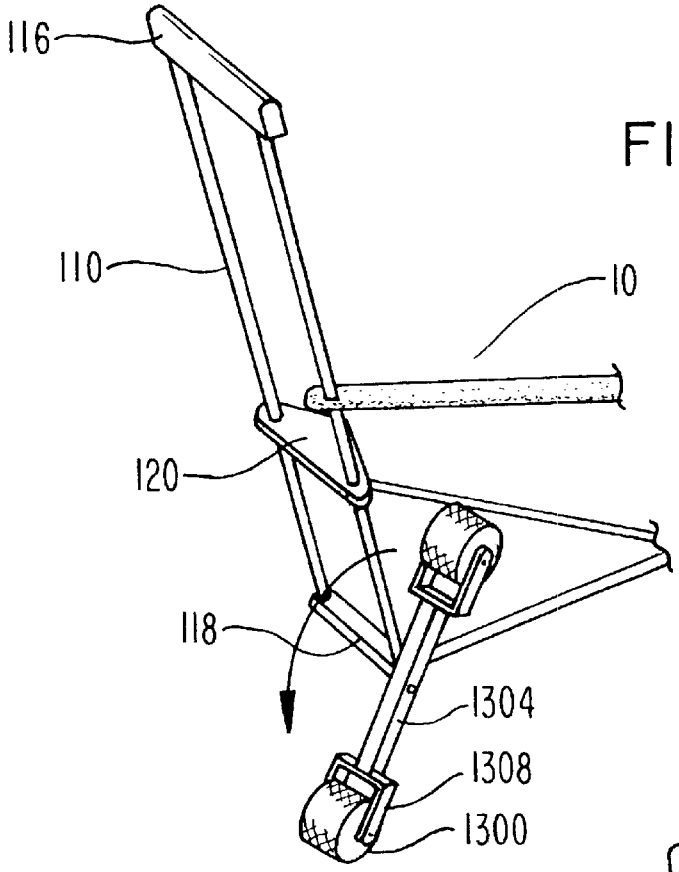
FIGS. 35–36 illustrate alternative embodiments of a support according to the present invention.

In one embodiment, the support 10 can also include wheels coupled to support members that are pivotally coupled to the frame. As illustrated in FIG. 35, a wheel 1300 is rotatably mounted to a wheel support member 1310 that is coupled to the frame. The wheel support member 1310 can be moved between an upper position and a lower position as represented by the arrow in FIG. 35. Thus, when the support 10 is in its expanded configuration the wheel 1300 can be pivoted into and out of contact with the support surface. A user can lift up the front frame portion of the support so that only the wheels contact the support surface. Accordingly, the user can easily pull the support to a different location.

Figure 36:
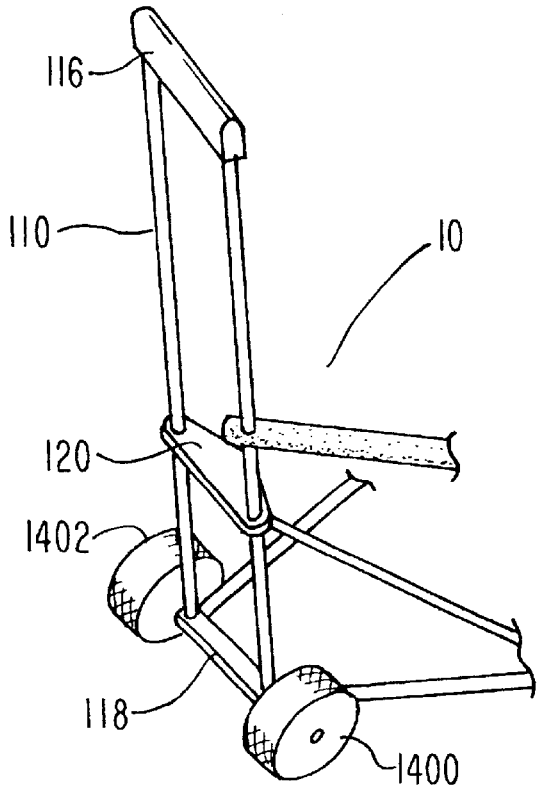

In another embodiment, the support 10 can include wheels 1400, 1402 as illustrated in FIG. 36. In this embodiment, the wheels 1400, 1402 are rotatably mounted to an axle positioned proximate to the lower coupler 118. A locking mechanism (not shown) can be provided to lock the wheels 1400, 1402.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A support assembly for a chair in which a user can be seated comprising:

a frame having a collapsed configuration and an expanded configuration, said frame including a front frame portion and a rear frame portion;

a seat portion coupled to said rear frame portion at a first elevation and coupled to said front frame portion at a second elevation, said first elevation being higher than said second elevation when said frame is in said expanded configuration; and a tension member coupled to said frame at a first location and a second location, said first location being on said rear frame portion, said second location being on said front frame portion, said tension member being coupled to said frame at a third location, said third location being on said front frame portion, said tension member extending substantially horizontally between said first location and said third location, said tension member extending substantially vertically between said third location and said second location, said tension member being selectively disposable on said frame in:

a first position when said frame is in said expanded configuration to provide support for an arm of the user, and a second position when said frame is in said collapsed configuration to be carried on a shoulder of the user.

2. The support assembly of claim 1, said tension member being disposed in said first position when coupled to said third location.

3. The support assembly of claim 1, wherein said seat portion is coupled to said front frame portion between said second location and said third location and supported on said frame.

4. The support assembly of claim 1, wherein said seat portion is formed of fabric.

5. The support assembly of claim 1, wherein said front frame portion includes an upper portion and a lower portion, said second location is on said lower portion, and said third location is on said upper portion.

6. The support assembly of claim 5, wherein said front frame portion includes first and second support members pivotally coupled to each other to form an "X" structure.

7. The support assembly of claim 5, wherein said tension member has an opening and said upper portion of said front frame portion is disposed in said opening when said tension member is in said first position.

8. The support assembly of claim 1, wherein said front frame portion includes a bottom surface adapted to rest on a support surface, and said second location is proximate said bottom surface.

9. The combination of the support assembly of claim 1 and a cover, said cover configured to receive a portion of said frame when said frame is in said collapsed configuration, said tension member extending from said cover when said portion of said frame is disposed in said cover and said tension member is in said second position.

10. The support assembly of claim 1, wherein said tension member is adjustable in length.

11. The support assembly of claim 1, said seat portion having a plurality of apertures therein, and said front frame portion includes first and second support members, and each of said first and second support members extending through one of said apertures.

12. The support of claim 11, wherein said first support member includes a first end and a second end, said tension member has an opening, and said first end of said first support member extends into said opening when said tension member is in said first position.

13. A method of deploying a collapsible chair having a frame disposable in a collapsed configuration and an expanded configuration, the frame including a front frame portion and a rear frame portion, a seat coupled to said frame and supported on said frame when said frame is in said expanded configuration, the seat being coupled to the rear frame portion at a first elevation and coupled to the front frame portion at a second elevation, the first elevation being higher than the second elevation when the frame is in the expanded configuration, and an adjustable tension strap coupled to said frame at a first location on said rear frame portion and at a second location on said front frame portion, the tension strap selectively coupled at a third location on said front frame portion, the tension strap extending substantially horizontally between the first location and the third location, the tension strap extending substantially vertically between the third location and the second location, the tension strap being disposable when said frame is in said expanded configuration to support an arm of a user seated in the chair, the method comprising:

positioning the frame in the expanded configuration; and shortening said strap to place said strap in tension.

14. The method of claim 13, further comprising further shortening said strap to adjust the disposition of said frame.

15. The method of claim 13, wherein the collapsible chair includes a cover configured to receive a portion of said frame when said frame is in a collapsed configuration, and a pouch, further comprising:

inserting the cover into the pouch.

16. The method of claim 13 wherein the front frame portion includes an upper portion and a lower portion, the method further comprising:

coupling said tension strap to the upper portion of the front frame portion.

17. The method of claim 17, wherein said upper portion includes a first end, said tension strap has an opening and said coupling of said tension strap includes inserting a first end of said upper portion into said opening.

18. A method of transporting a collapsible chair having a frame including a front frame portion and a rear frame portion and being disposable in a collapsed configuration and an expanded configuration, a seat coupled to said frame and supported on said frame when said frame is in said expanded configuration, the seat being coupled to the rear frame portion at a first elevation and coupled to the front frame portion at a second elevation, the first elevation being higher than the second elevation when the frame is in the expanded configuration, and a tension strap being coupled to said rear frame portion at a first location and coupled to said front frame portion at a second location and selectively coupled to said front frame portion at a third location, the tension strap extending substantially horizontally between the first location and the third location, the tension strap extending substantially vertically between the third location and the second location, the method comprising:

uncoupling said strap from said third location of said frame;

collapsing said frame; and disposing said strap on a shoulder of a user to support said chair on the user.

19. The method of 18, wherein said strap is adjustable in length, and in a shortened position is under tension, the method further comprising:

lengthening said strap to reduce tension before uncoupling said strap from said third location of said frame.

20. The method of claim 19, further comprising:

adjusting the length of said strap to fit the user.

21. A frame for a support, the frame having a collapsed configuration and an expanded configuration, the frame comprising:

a front frame portion;

a rear frame portion including a coupler slidably mounted on said rear frame portion;

lower side support members pivotally coupled to said front frame portion and said rear frame portion;

upper side support members, each of said upper side support members including an upper end and a lower end, said lower ends pivotally coupled to said front frame portion and said upper ends pivotally coupled to said coupler; and an extension member connected to said coupler, said extension member adapted to be grasped and pulled by a user to move said coupler between a first position when said frame is in said expanded configuration and a second position along said rear frame portion, said movement of said coupler causing the upper ends of said upper side support members to move along said rear frame portion, thereby causing said side support members to move said front frame portion closer to said rear frame portion.

22. The frame of claim 21, further comprising:

a tension member coupled to said frame and selectively disposable on said frame in a first position when said frame is in said expanded configuration to provide support for an arm of the user, said tension member including a first end and a second end, said first end being slidably mounted on said rear frame and supported by said extension member.

23. A method of collapsing a support having a frame including a front frame portion, a rear frame portion including a slide plate, support members coupled to said front frame portion and said slide plate, and an extension member coupled to said slide plate, the frame being disposable in a collapsed configuration and an expanded configuration, the method comprising:

grasping said extension member; and pulling on said extension member relative to said rear frame portion to position said frame in said collapsed configuration.

24. The method of claim 23, wherein said frame includes a tension member coupled to said frame and disposable in a first position when said frame is in said expanded configuration to support an arm of a user on said support and in a second position when said frame is in said collapsed configuration to be carried on a shoulder of the user, the method further comprising:

decoupling said tension member from said front frame portion.

25. The method of claim 24, wherein said tension member is coupled to said extension member, the method further comprising:

pivoting said tension member about said rear frame portion from said first position to said second position as said frame moves from said expanded configuration to said collapsed configuration.

26. A frame for a support having a collapsed configuration and an expanded configuration, the frame comprising:

a front frame portion;

a rear frame portion including a coupler having a first mounting portion and a second mounting portion, said rear frame portion including first and second rear support members, said first rear support member being coupled to said first mounting portion, and said second rear support member being coupled to said second mounting portion; and first and second side support members coupled to said front frame portion, said first side support member being pivotally coupled to said first mounting portion in front of said first rear support member and being movable in a first plane between a first position when said frame is in said collapsed configuration and a second position when said frame is in said expanded configuration, said second side support member being pivotally coupled to said second mounting portion in front of said second rear support member and being movable in a second plane, said second plane intersecting said first plane.

27. The frame of claim 26 wherein said rear support members extending in a third plane, said third plane intersecting said first and second planes.

28. The frame of claim 27 wherein said first mounting portion includes a first coupling portion and a second coupling portion oriented at an angle with respect to said first coupling portion, said first rear support member being coupled to said first coupling portion, said first side support member being coupled to said second coupling portion.

29. A support comprising:

a frame having a collapsed configuration and an expanded configuration; and a cushion coupled to said frame and selectively disposable on said frame in:

a first position, when said frame is in said expanded configuration, where a head of a user can be located when the user is seated on said support, and a second position, when said frame is in said collapsed configuration, disposed between said frame and a user's body when said frame is carried on a shoulder of the user.

30. The support of claim 29 wherein said cushion is selectively disposable on said frame in a third position, when said frame is in said expanded configuration, to provide support for a user's body, said third position being lower than said first position along said frame.

31. The support of claim 30 wherein said frame includes a strap coupled thereto, said cushion being slidably mounted on said strap for movement between said first position and said third position.

32. The support assembly of claim 1 wherein said frame is self-supporting in that said frame does not rely on said tension members for support in said extended configuration.

33. A support assembly for a chair comprising:

a frame, said frame including a front frame portion and a rear frame portion, said front frame portion having an upper end and a lower end, said rear frame portion having an upper end and a lower end, said frame being disposable in an expanded configuration and in a collapsed configuration, said upper end of said front frame portion being disposed proximate to said upper end of said rear frame portion when said frame is in said collapsed configuration; and a tension member, said tension member being coupled to said rear frame portion and being coupled to said lower end of said front frame portion, said tension member being coupled proximate to said upper end of said rear frame portion and coupled to said lower end of said front frame portion when said frame is in said collapsed configuration, said frame being self-supporting in that said frame does not rely on said tension member for support in said expanded configuration.

34. A support assembly for a chair comprising:

a frame, said frame being disposable in a collapsed configuration and in an expanded configuration, said frame including a front frame portion and a rear frame portion;

a seat portion, said seat portion being coupled to said front frame portion and to said rear frame portion; and a strap, said strap having a first end and a second end, said first strap end being coupled to said rear frame portion at a first location, said second strap end being coupled to said front frame portion at a second location, said second location located below said seat portion when said frame is in said expanded configuration.

35. A support assembly for a chair comprising:

a frame, said frame having a plurality of frame components, said frame components including a front frame portion having an upper end and a lower end, and a rear frame portion having an upper end and a lower end, said frame being disposable in an expanded configuration and in a collapsed configuration; and a tension member, said tension member being coupled to said rear-frame portion and to said front frame portion, said tension member being coupled to said upper end of said rear frame portion in said collapsed configuration and being coupled to said lower end of said front frame portion in said collapsed configuration, wherein in said collapsed configuration every component of said frame extends substantially parallel to the other components of said frame, said frame being self-supporting in that said frame does not rely on said tension member for support in said expanded configuration.

* * * * *

UNITED STATES PATENT AND TRADEMARK OFFICE

CERTIFICATE OF CORRECTION

PATENT NO. : 6,698,827 B2
DATED : March 2, 2004
INVENTOR(S) : Brian Edward Le Gette et al.

It is certified that error appears in the above-identified patent and that said Letters Patent is hereby corrected as shown below:

Column 7,
Line 47, “a long” to -- along --

Column 9,
Line 57, “1111” to -- 1110 --

Column 14,
Line 51, “rear-frame” to -- rear frame --

Signed and Sealed this

Thirteenth Day of July, 2004

JON W. DUDAS
*Acting Director of the United States Patent and Trademark Office*